US007850488B2

(12) United States Patent
Ikegami et al.

(10) Patent No.: US 7,850,488 B2
(45) Date of Patent: Dec. 14, 2010

(54) HIGH-SPEED TRANSMISSION CONNECTOR WITH GROUND TERMINALS BETWEEN PAIR OF TRANSMISSION TERMINALS ON A COMMON FLAT SURFACE AND A PLURALITY OF GROUND PLATES ON ANOTHER COMMON FLAT SURFACE

(75) Inventors: Fumihito Ikegami, Ichikawa (JP); Toshiyasu Ito, Tougane (JP); Shunsuke Morita, Tokyo (JP); Hiroaki Kukita, Kasukabe (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 12/560,065

(22) Filed: Sep. 15, 2009

(65) Prior Publication Data

US 2010/0068933 A1 Mar. 18, 2010

(30) Foreign Application Priority Data

Sep. 17, 2008 (JP) ..... 2008-238319

(51) Int. Cl.
*H01R 13/648* (2006.01)

(52) U.S. Cl. ..... 439/607.05

(58) Field of Classification Search ..... 439/607.05, 439/607.44, 108, 497, 65, 941
See application file for complete search history.

(56) References Cited

U.S. PATENT DOCUMENTS

| | | | | |
|---|---|---|---|---|
| 4,846,727 | A | 7/1989 | Glover et al. | |
| 4,975,084 | A | 12/1990 | Fedder et al. | |
| 5,104,341 | A | 4/1992 | Gilissen et al. | |
| 5,215,473 | A | 6/1993 | Brunker et al. | |
| 5,645,436 | A | 7/1997 | Shimizu et al. | |
| 6,203,376 | B1 * | 3/2001 | Magajne et al. | 439/607.44 |
| 6,280,242 | B1 * | 8/2001 | Jochen et al. | 439/497 |
| 6,293,827 | B1 | 9/2001 | Stokoe | |
| 6,394,822 | B1 | 5/2002 | McNamara | |
| 6,409,543 | B1 | 6/2002 | Astbury, Jr. et al. | |
| 6,461,202 | B2 | 10/2002 | Kline | |
| 6,506,076 | B2 | 1/2003 | Cohen et al. | |
| 6,517,360 | B1 | 2/2003 | Cohen | |
| 6,540,522 | B2 | 4/2003 | Sipe | |

(Continued)

FOREIGN PATENT DOCUMENTS

JP 02-137775 5/1990

(Continued)

OTHER PUBLICATIONS

Office Action in co-pending U.S. Appl. No. 11/902,474, dated Jan. 28, 2009.

(Continued)

*Primary Examiner*—Chandrika Prasad
(74) *Attorney, Agent, or Firm*—Finnegan, Henderson, Farabow, Garrett & Dunner, LLP

(57) ABSTRACT

The present invention is to provide each of pairs of transmission contact terminals in contact units are arranged between each of two adjacent ground contact terminals. A pair of shielding pieces of each of contact plate is formed to separate fixed terminal portions of the pair of transmission contact terminals of one of the contact unit from those of the adjacent one of the contact unit.

10 Claims, 27 Drawing Sheets

U.S. PATENT DOCUMENTS 6,551,140 B2 4/2003 Billman et al.
6,602,095 B2 8/2003 Astbury, Jr. et al.
6,623,302 B2 9/2003 Billman et al.
6,623,310 B1 9/2003 Billman et al.
6,634,908 B1 10/2003 Billman et al.
6,638,079 B1 10/2003 Billman et al.
6,638,110 B1 10/2003 Billman
6,641,438 B1 11/2003 Billman
6,645,009 B1 11/2003 Billman et al.
6,652,318 B1 11/2003 Winings et al.
6,652,319 B1 11/2003 Billman
6,663,401 B2 12/2003 Billman et al.
6,663,427 B1 12/2003 Billman et al.
6,682,369 B1 1/2004 Korsunsky et al.
6,692,272 B2 2/2004 Lemke et al.
6,692,305 B2 2/2004 Nelson et al.
6,705,895 B2 3/2004 Hasircoglu
6,712,646 B2 3/2004 Shindo
6,739,918 B2 5/2004 Cohen et al.
6,746,278 B2 6/2004 Nelson et al.
6,749,468 B2 6/2004 Avery
6,764,340 B2 7/2004 Toda
6,764,349 B2 7/2004 Provencher et al.
6,769,935 B2 8/2004 Stokoe et al.
6,808,399 B2 10/2004 Rothemel et al.
6,808,419 B1 10/2004 Korsunsky et al.
6,817,868 B2 11/2004 Matsuo et al.
6,827,611 B1 12/2004 Payne et al.
6,843,686 B2 1/2005 Ohnishi et al.
6,848,917 B2 2/2005 Lang et al.
6,851,980 B2 2/2005 Nelson et al.
6,863,549 B2 3/2005 Brunker et al.
6,872,085 B1 3/2005 Cohen et al.
6,875,031 B1 4/2005 Korsunsky et al.
6,884,117 B2 4/2005 Korsunsky et al.
6,890,215 B2 5/2005 Lang et al.
6,893,295 B1 * 5/2005 Lloyd et al. ..... 439/607.05
6,918,789 B2 7/2005 Lang et al.
6,923,664 B2 8/2005 Ito et al.
6,945,787 B2 9/2005 Matsuo
6,976,886 B2 12/2005 Winings et al.
6,981,883 B2 1/2006 Raistrick et al.
6,986,682 B1 1/2006 Jeon
6,988,902 B2 1/2006 Winings et al.
6,994,569 B2 2/2006 Minich et al.
7,040,901 B2 5/2006 Benham et al.
7,044,793 B2 5/2006 Takemasa
7,059,907 B2 6/2006 Winings et al.
7,083,432 B2 8/2006 Hull et al.
7,094,102 B2 8/2006 Cohen et al.
7,101,191 B2 9/2006 Benham et al.
7,108,556 B2 9/2006 Cohen et al.
7,112,098 B2 9/2006 Matsuo et al.
7,114,964 B2 10/2006 Winings et al.
7,118,391 B2 10/2006 Minich et al.
7,121,889 B1 10/2006 Jeon
7,131,870 B2 11/2006 Whiteman, Jr. et al.
7,182,643 B2 2/2007 Winings et al.
7,229,318 B2 6/2007 Winings et al.
7,309,239 B2 12/2007 Shuey et al.
7,331,800 B2 2/2008 Winings et al.
7,390,200 B2 6/2008 Shuey et al.
7,390,218 B2 6/2008 Smith et al.
7,442,054 B2 10/2008 Lemke et al.
7,467,955 B2 12/2008 Raistrick et al.
2002/0123254 A1 9/2002 Kato et al.
2004/0092143 A1 5/2004 Fromm et al.
2005/0170700 A1 8/2005 Shuey et al.
2005/0196987 A1 9/2005 Shuey et al.
2006/0019517 A1 1/2006 Raistrick et al.
2007/0099455 A1 * 5/2007 Rothermel et al. ..... 439/108
2008/0214029 A1 9/2008 Lemke et al.
2008/0248693 A1 10/2008 Winings et al.

FOREIGN PATENT DOCUMENTS

JP 02-265183 10/1990
JP 2000-311749 11/2000
JP 2002-075544 3/2002
JP 2002-117938 4/2002
JP 2002-513502 5/2002
JP 3326507 7/2002
JP 2002-530840 9/2002
JP 2003-522385 7/2003
JP 2003-522387 7/2003
JP 3470318 9/2003
JP 2004-521448 7/2004
JP 2004-363032 12/2004
JP 3754959 12/2005
JP 2006-066381 3/2006
JP 2007-501501 1/2007
JP 2007-115707 5/2007
WO WO 02/060011 8/2002

OTHER PUBLICATIONS

Office Action in co-pending U.S. Appl. No. 11/902,474, dated Jun. 12, 2009.
Official Letter in Japanese Patent Appln. No. 2008-238319: Decision to Grant A Patent (Jul. 7, 2010).

* cited by examiner

HIGH-SPEED TRANSMISSION CONNECTOR WITH GROUND TERMINALS BETWEEN PAIR OF TRANSMISSION TERMINALS ON A COMMON FLAT SURFACE AND A PLURALITY OF GROUND PLATES ON ANOTHER COMMON FLAT SURFACE

This application claims the benefit of Japanese Patent Application No. 2008-238319, filed Sep. 17, 2008, which is hereby incorporated by reference herein in its entirety.

BACKGROUND OF THE INVENTION

1. Field of the Invention

The present invention relates to a high-speed transmission connector which comprises multiple blade-type contact units and which forms a part of a high-speed signal transmission path, a plug for the high-speed transmission connector, and a socket for the high-speed transmission connector.

2. Description of the Related Art

In a communication system, when data transmission is carried out at relatively high-speed, a differential transmission system is employed to achieve high-speed signal transmission, for example, at 2.5 Gbps or more per a channel. In a transmission path in which such a differential transmission system is employed, for example, a high-speed transmission connector has been in practical use for electrically connecting a mother board with a daughter board, both boards being wiring boards. As such a high-speed transmission connector, for example, a board-to-board connector is proposed, for example, as shown in Japanese Patent Application Laid-open No. 2002-530840.

In Japanese Patent Application Laid-open No. 2002-530840, such a board-to-board connector has a structure which is fixed to each of the wiring boards and is attachably/detachably connected to another connector. Each connector is provided with multiple wafer-like modules. Each module comprises as main elements: a dielectric supporting body (see FIG. 5) having signal conductors insert-molded in parallel to each other at predetermined intervals; and a plate-shaped shielding member (see FIGS. 4 and 11) laid on the dielectric supporting body. At that time, each of connecting portions of the signal conductors of the dielectric supporting body which are soldered and fixed to respective contact pads of the wiring board are arranged so as to be positioned between each of two adjacent connecting portions of the shielding member facing thereto.

In the high-speed transmission path as described above, for example, impedance mismatching within the connector, which causes signal reflection, is not neglectable. Accordingly, the impedance matching within the connector is required. Moreover, it is necessary to prevent crosstalk between adjacent signal transmission paths in the connector.

SUMMARY OF THE INVENTION

However, when the connector shown in the aforementioned Japanese Patent Application Laid-open No. 2002-530840 is used in transmission paths of signals in a relatively high frequency range which are provided for a communication system or the like, the adjacent modules are not shielded therebetween since the each of the connecting portions of the signal conductors of the dielectric supporting body are positioned between each of the two adjacent connecting portions of the shielding member facing thereto as described above. It is therefore necessary to take measures against crosstalk between the transmission paths of the signal conductors of the modules adjacent to each other. Moreover, when the dielectric supporting body has signal conductors insert-molded in parallel to each other at predetermined intervals like the connector shown in Japanese Patent Application Laid-open No. 2002-530840, it is necessary to take measures against crosstalk between each pair of signal transmission paths formed on a common plane in a same module.

In the light of the above-described problems, the present invention aims to provide a high-speed transmission connector including a plurality of blade-type contact units and forming a part of a high-speed transmission path, a plug for the high-speed transmission connector, and a socket for the high-speed transmission connector. The high-speed transmission connector, the plug for the high-speed transmission connector, and the socket for the high-speed transmission connector can reliably prevent from the crosstalk between signal transmission paths in a same contact unit and the crosstalk between signal transmission paths of adjacent contact units.

To achieve the described object, one aspect of the present invention provides a high-speed transmission connector comprising: a plurality of first contact units each having: a pair of transmission contact terminals each of which has a fixed terminal portion fixed to a first wiring board, and which respectively form two adjacent high-speed signal transmission paths on one common flat surface of a transmission blade; ground contact terminals each of which has a fixed terminal portion fixed to the first wiring board, and which are arranged respectively between the pairs of transmission contact terminals; and a plurality of ground contact plates arranged on another common flat surface of the transmission blade; the high-speed transmission connector having: a plug section having a casing accommodating the first contact units; a plurality of second contact units each having: a pair of transmission contact terminals each of which has a fixed terminal portion fixed to a second wiring board, and which respectively form two adjacent high-speed signal transmission paths on one common flat surface of a transmission blade; ground contact terminals each of which has a fixed terminal portion fixed to the second wiring board, and which are arranged respectively on both sides of the pair of transmission contact terminals; and a plurality of ground contact plates arranged on another common flat surface of the transmission blade; and the high-speed transmission connector has a socket section capable of being selectively connected to the plug section, the socket section having a casing accommodating the second contact units. In the high-speed transmission connector, a pair of transmission contact terminals of the first and second contact units is provided so as to be opposed to one of the ground contact plate.

Moreover, another aspect of the present invention provides a plug for a high-speed transmission connector according to the present invention comprising: a plurality of contact units each having; a pair of transmission contact terminals each of which has a fixed terminal portion fixed to a wiring board, and which respectively form two adjacent high-speed signal transmission paths on one common flat surface of a transmission blade; ground contact terminals each of which has a fixed terminal portion fixed to the wiring board, and which are arranged respectively on both sides of the pair of transmission contact terminals; and a plurality of ground contact plates arranged on another common flat surface of the transmission blade; and the plug includes: a casing accommodating the contact units. In the plug, each of the ground contact plates of each of the contact units includes a shielding piece protruding toward the wiring board so as to partition off between the fixed terminal portions of the pair of transmission contact terminals of the adjacent contact unit.

Furthermore, yet another aspect of the present invention provides a socket for a high-speed transmission connector comprising: a plurality of contact units having; a pair of transmission contact terminals each of which includes a fixed terminal portion fixed to a wiring board, and which respectively form two adjacent high-speed signal transmission paths on one common flat surface of a transmission blade; ground contact terminals each of which has a fixed terminal portion fixed to the wiring board, and which are arranged respectively on both sides of the pair of transmission contact terminals; and a plurality of ground contact plates arranged on another common flat surface of the transmission blade; and the plug comprising a casing accommodating the contact units. In the plug, each of the ground contact plates of each of the contact units has a shielding piece protruding toward the wiring board so as to partition off between the fixed terminal portions of the pair of transmission contact terminals of the adjacent contact unit.

According to the high-speed transmission connector, the plug for high-speed transmission connector, and the socket for high-speed transmission connector in accordance with the present invention, each of the multiple first contact units and second contact units comprises: ground contact terminals each arranged on both sides of the corresponding pair of transmission contact terminals; and the plurality of ground contact plates arranged on another common flat surface of the transmission blade on the other side thereof. Moreover, each of the ground contact plates of each of the first contact units has a shielding piece protruding toward the first wiring board so as to partition off between the fixed terminal portions of the pair of transmission contact terminals of the adjacent first contact unit, and each of the ground contact plates of each of the second contact units has a shielding piece protruding toward the second wiring board so as to partition off between the fixed terminal portions of the pair of transmission contact terminals of the adjacent second contact unit. Accordingly, it is possible to assuredly prevent crosstalk between the signal transmission paths in a common contact unit and crosstalk between the signal transmission paths of the adjacent contact units.

Further features of the present invention will become apparent from the following description of exemplary embodiments (with reference to the attached drawings).

DESCRIPTION OF THE EMBODIMENTS

Figure 5:
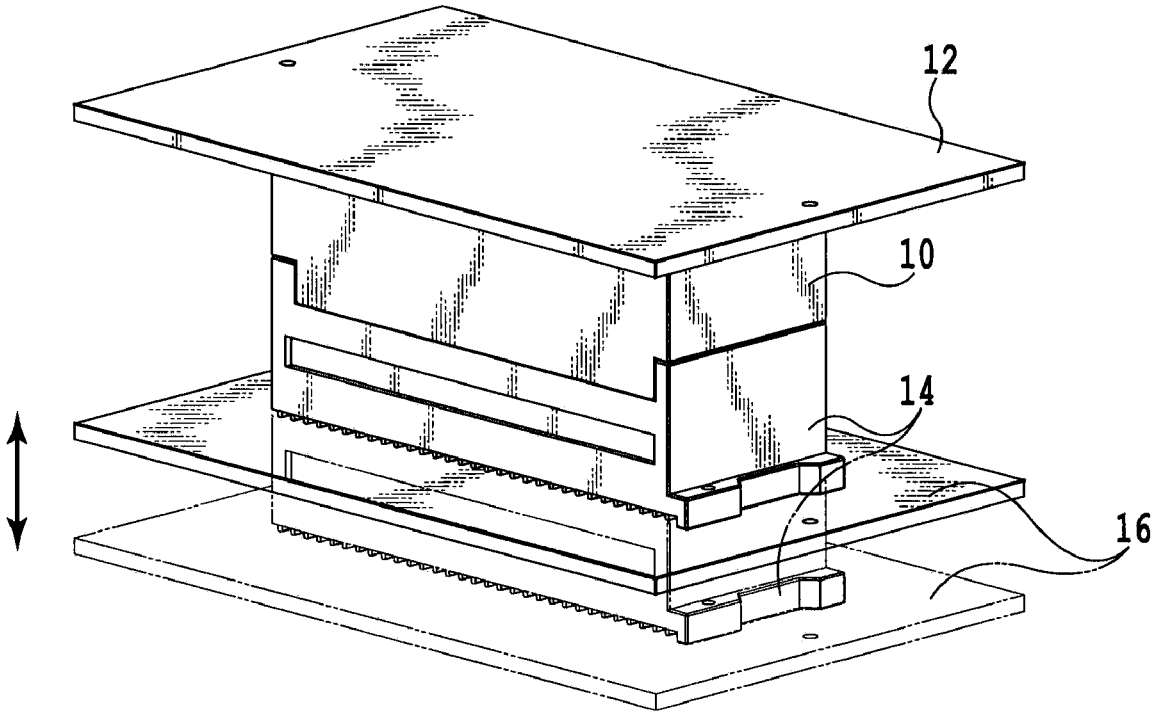
FIG. 5 is a perspective view schematically showing the entire constitution of the embodiment of the high-speed transmission connector according to the present invention.

FIG. 5 shows an appearance of one embodiment of a high-speed transmission connector according to the present invention.

In FIG. 5, the high-speed transmission connector is a board-to-board connector including: a plug section 10 fixed to a given printed wiring board 12; and a socket section 14 fixed to another given printed wiring board 16. FIG. 5 shows a state where the plug section 10 is connected to the socket section 14. The high-speed transmission connector may be selectively applicable to a single ended or differential transmission system as described later.

The plug section 10 is configured to be detachable/attachable from the socket section 14. The plug section 10 includes a casing 10C (see FIG. 6) provided with multiple slits 10Si (i=1 to n, where n is a positive integer) detachably/attachably accommodating later-described blade-type contact units 18Bi (i=1 to n, where n is a positive integer). The slits 10Si are arranged at predetermined intervals substantially in parallel to each other along X coordinate axis of an orthogonal coordinate system shown in FIG. 6, i.e. along a long side of the casing 10C. Each two adjacent slits 10Si are partitioned with partition wall 10Wi.

Figure 14:
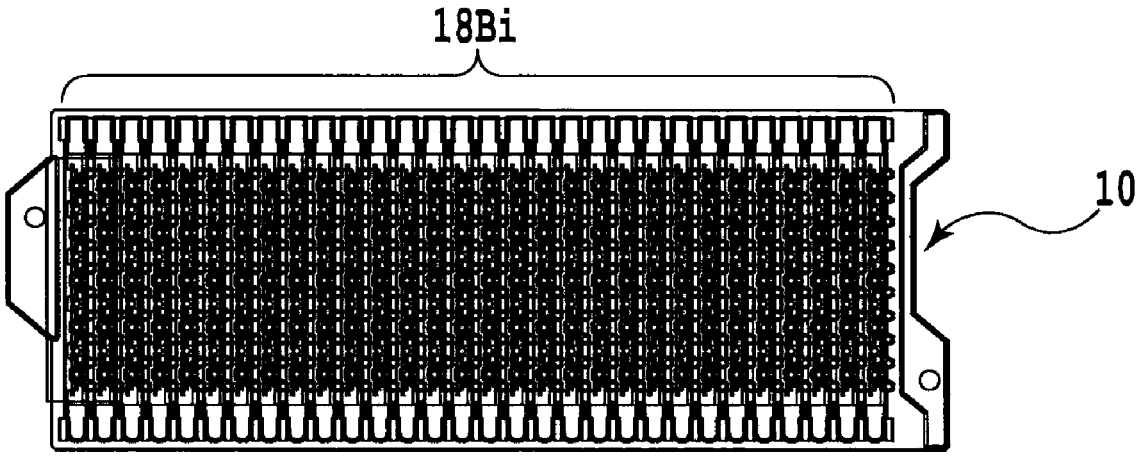
FIG. 14 is a bottom view of the plug section shown in FIG. 6.

The casing 10C is molded of resinous material, for example, liquid crystal polymer (LCP), and has a bottom surface portion substantially parallel to a surface of the printed wiring board 12 where a conductor pattern is formed. In the bottom surface portion, as enlarged in FIGS. 14 and 15, open ends communicating with the aforementioned slits 10Si are opened at predetermined intervals.

To each open end, fitting portions 26SH of a transmission blade 26 of each blade-type contact unit 18Bi, which will be described later, are detachably/attachably fitted. In the bottom surface portion of the transmission blade 26, ground solder terminals and signal solder terminals of each of the later described blade-type contact units 18Bi are exposed.

Figure 6:
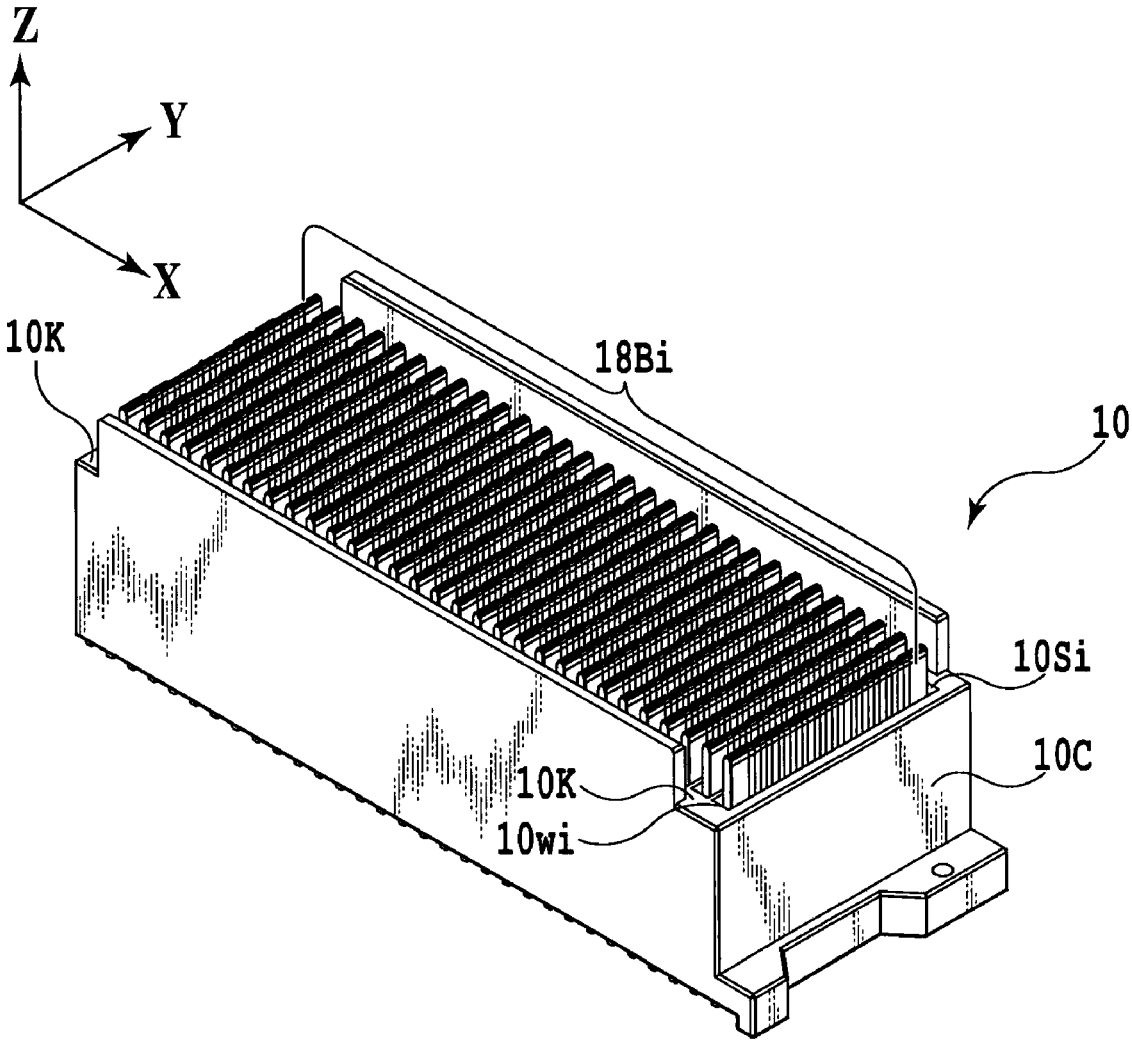
FIG. 6 is a perspective view showing the plug section used in the embodiment of the high-speed transmission connector according to the present invention.

As shown in FIG. 6, at each short side of the casing 10C, a recess 10K is formed, which is engaged with a connecting edge portion 14K (see FIG. 7) of a later-described socket section 14. When the plug section 10 is connected to the later-described socket section 14 together with the printed wiring board 12, upper edges of both side walls on the long sides of the casing 10C are engaged with recess portions 14R (see FIG. 7) of corresponding both side walls of the later-described socket section 14.

Figure 1:
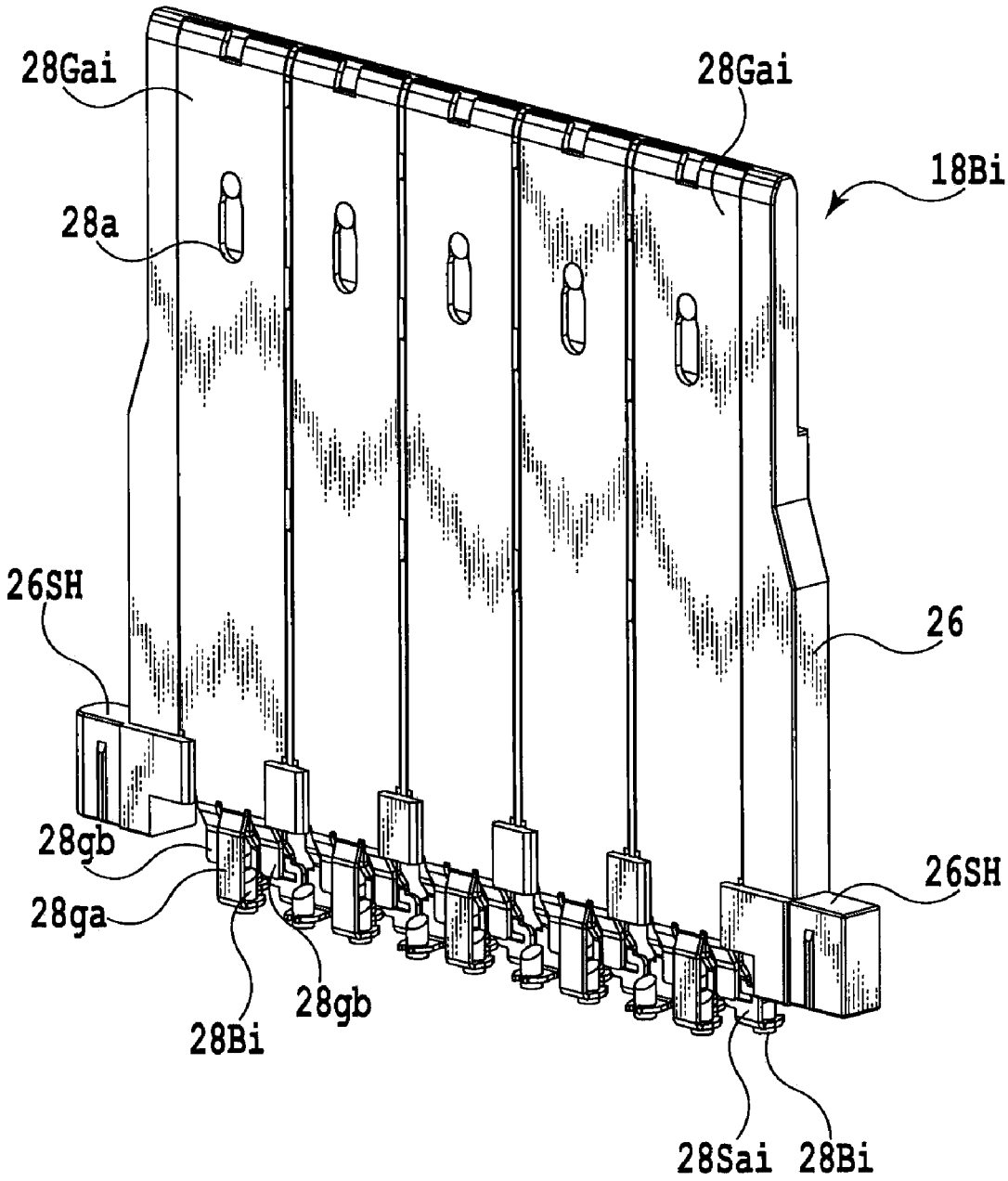
FIG. 1 is a perspective view showing an appearance of a contact unit in a plug section used in one embodiment of a high-speed transmission connector according to the present invention.

As enlarged in FIG. 1, each of the contact units 18Bi used in one embodiment of the high-speed transmission connector according to the present invention comprises: multiple, for example, five ground contact plates 28Gai (i=1 to 5); four ground contact terminals 28Gbi (i=1 to 4) (see FIGS. 2, 27A, and 27B); multiple, for example, five each transmission contact terminals 28Sai and 28Sbi (i=1 to 5) transmitting signals or data; and a transmission blade 26 supporting the ground contact plates 28Gai, ground contact terminals 28Gbi, and transmission contact terminals 28Sai and 28Sbi at the corresponding surfaces.

The transmission blade 26 is a thin plate with a thickness of about 1 mm, and is molded of resinous material. As shown in FIG. 1, the transmission blade 26 has the fitting portions 26SH at both ends at the bottom portion, the fitting portions SH being fit to the open end of one of the aforementioned slits 10Si. On one surface of the transmission blade 26, relatively shallow grooves are formed, into which the ground contact plates 28Gai are inserted, respectively. At a predetermined position in upper part of each groove, a positioning pin which is engaged with a hole 28*a* of the corresponding ground contact plate 28Gai is formed.

Figure 2:
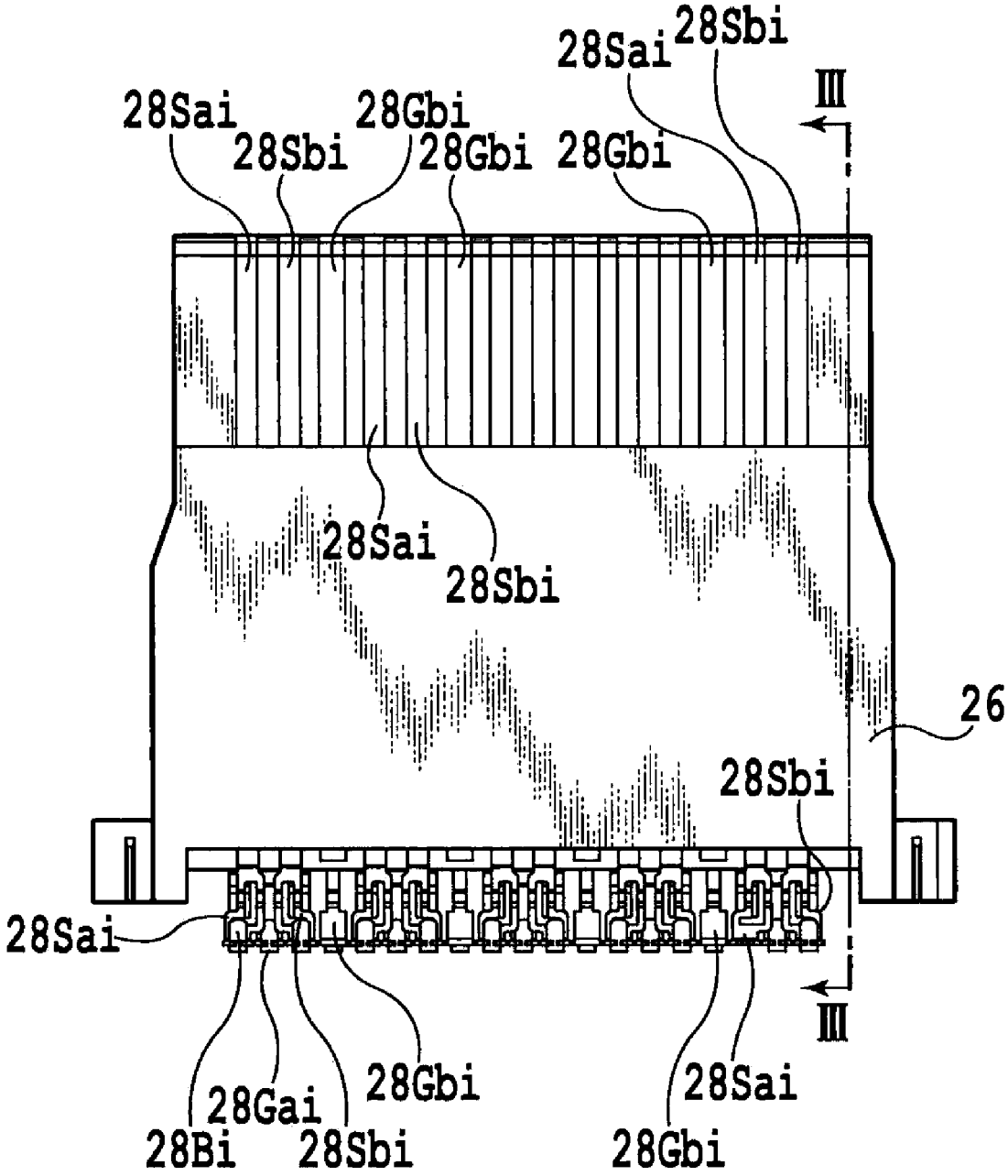
FIG. 2 is a front view of the contact unit shown in FIG. 1.

On the other surface of the transmission blade 26, as enlarged in FIG. 2, contact portions exposed and formed in upper parts of the ground contact terminals 28Gbi and transmission contact terminals 28Sai and 28Sbi, which are simultaneously casted at a time for insert molding. A pair of transmission contact terminals 28Sai and 28Sbi, the first ground contact terminal 28Gbi, another pair of transmission contact terminals 28Sai and 28Sbi, the second ground contact terminal 28Gbi, another pair of transmission contact terminals 28Sai and 28Sbi, the third ground contact terminal 28Gbi, another pair of transmission contact terminals 28Sai and 28Sbi, the fourth ground contact terminal 28Gbi, and another pair of transmission contact terminals 28Sai and 28Sbi are arranged in order starting from the left end in FIG. 2: and they are thin plates made of a copper alloy material, for example, a phosphor-bronze alloy material.

Hereby, since each of the ground contact terminals 28Gbi is arranged among adjacent pairs of the transmission contact terminals 28Sai and 28Sbi, crosstalk between the adjacent pairs of signal transmission paths is suppressed.

The width of the contact portions of the ground contact terminals 28Gbi are set to wider than the width of each of a pair of the contact portions of the transmission contact terminals 28Sai and 28Sbi. This can make it possible to easily try to improve impedance matching within the connector in the interplay of the contact terminals of the later-described socket section 14.

Figure 11:
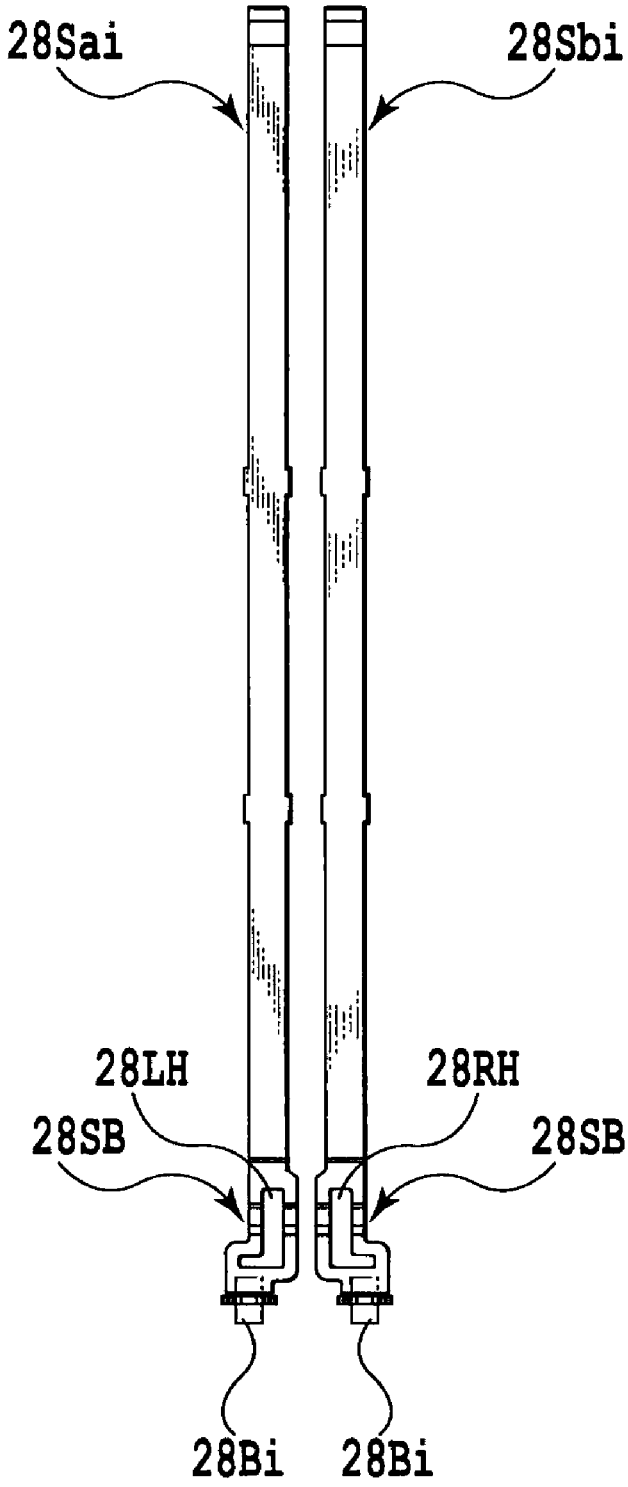
FIG. 11 is a front view showing a set of transmission contact terminals used in the single contact unit shown in FIG. 1.

As enlarged in FIG. 11, each of a pair of the transmission contact terminals 28Sai and 28Sbi comprises: the contact portion formed in its upper part; a fixed terminal portion 28SB formed in its lowest part; and a connecting portion connecting the contact portion and the fixed terminal portion 28SB.

Figure 12:
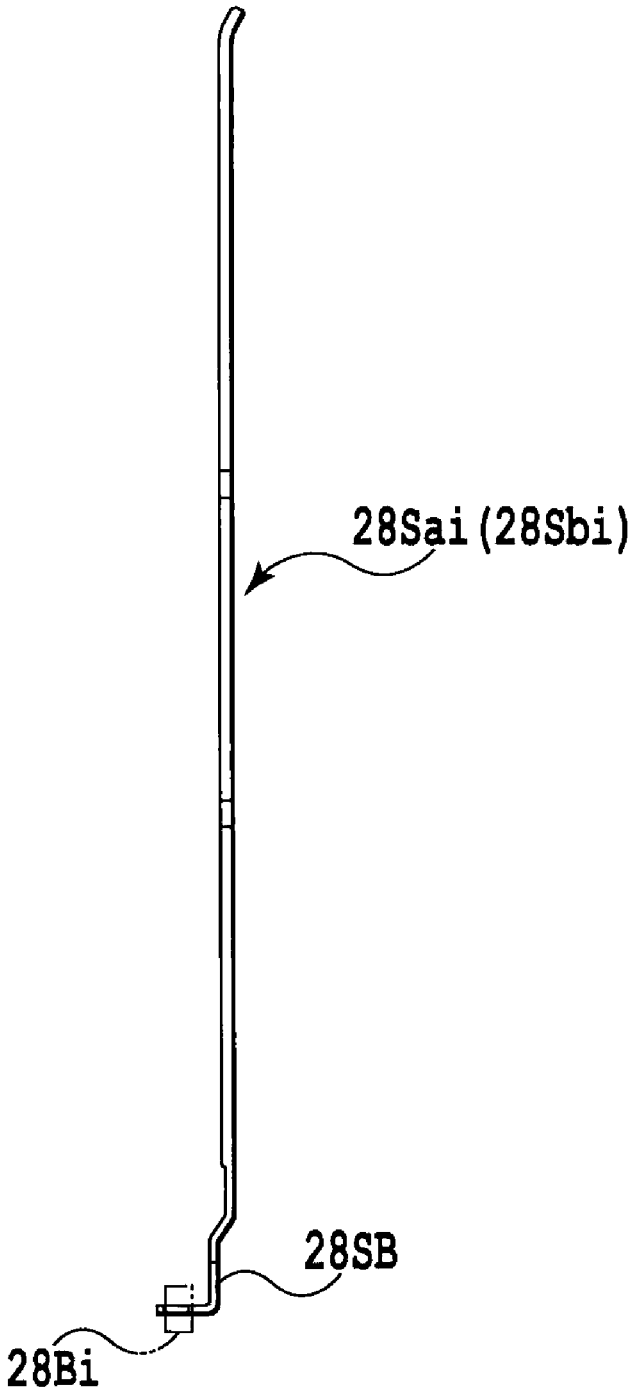
FIG. 12 is a side view showing the set of transmission contact terminals shown in FIG. 11.

The fixed terminal portion 28SB of transmission contact terminal 28Sai is formed so as to be deviated to the left by a predetermined amount with respect to the central axis of the contact portion and connecting portion in FIG. 11. As shown in FIG. 12, the fixed terminal portion 28SB is bent in a direction opposite to the direction in which the bent portion at the tip of the contact portion is bent, i.e. in a direction away from the transmission blade 26. Furthermore, a hole 28LH is formed in the fixed terminal portion 28SB to prevent a crack from occurring in a solder terminal 28Bi upon soldering the solder terminal onto the printed wiring board 12 and to increase spring strength of the terminal portion. The hole 28LH is punched out so as to extend down along the central axis of the fixed terminal portion 28SB and then bend to the left. At the utmost portion of the fixed terminal portion 28SB, a horseshoe-shaped holding portion which holds the solder terminal 28Bi by caulking is formed.

Figure 13:
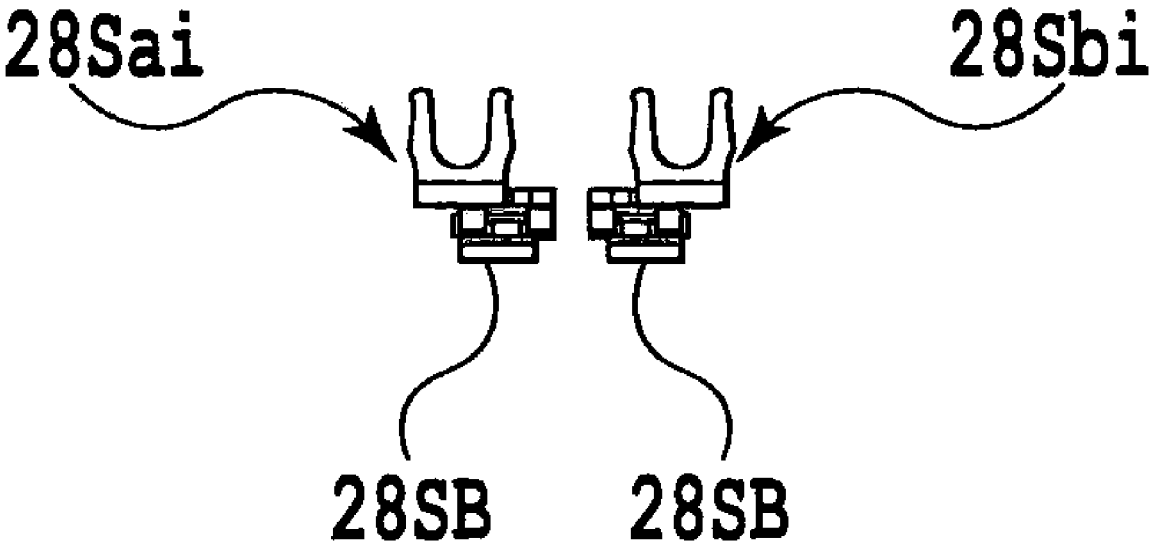
FIG. 13 is a bottom view showing the set of transmission contact terminals shown in FIG. 11.

The fixed terminal portion 28SB of transmission contact terminal 28Sbi is formed so as to be deviated toward the right by a predetermined amount with respect to the central axis of the contact portion and connecting portion in FIG. 11. As shown in FIG. 12, the fixed terminal portion 28SB is bent in a direction opposite to the direction in which the bent portion at the tip of the contact portion is bent, i.e. in a direction away from the transmission blade 26. Furthermore, a hole 28RH is formed in the fixed terminal portion 28SB to prevent a crack from occurring in a solder terminal 28Bi and to increase spring strength of the terminal portion. The hole 28RH is punched out so as to extend down along the central axis of the fixed terminal portion 28SB and then bend toward the right in FIG. 11. As shown in FIG. 13, at the utmost portion of the fixed terminal portion 28SB, a horseshoe-shaped holding portion which holds the solder terminal 28Bi by caulking is formed.

Figure 27A:
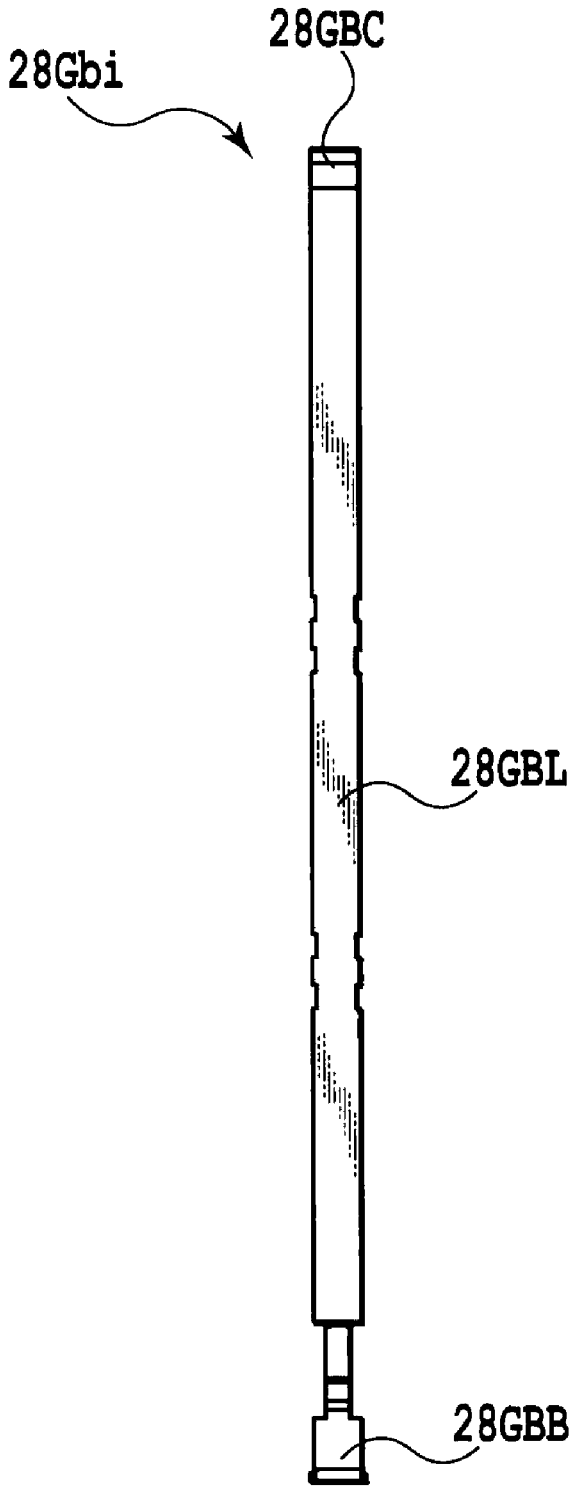
FIGS. 27A and 27B are front and side views of the ground contact terminal, respectively.
Figure 27B:
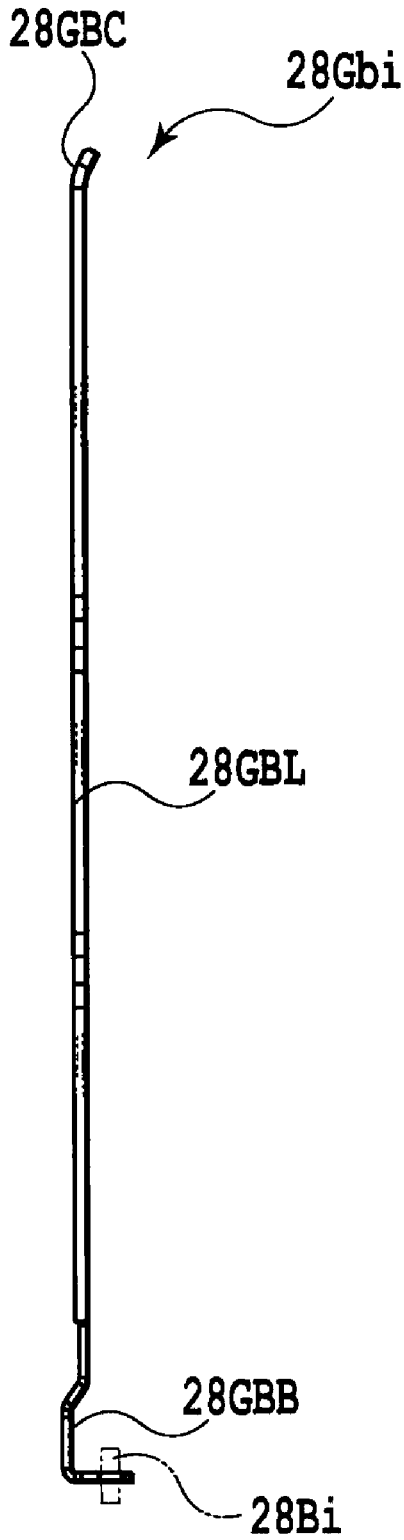

As enlarged in FIGS. 27A and 27B, each ground contact terminal 28Gbi includes: a contact portion 28GBC formed in its upper part; a fixed terminal portion 28GBB formed in its lowest part; and a connecting portion 28GBL connecting the contact potion and the fixed terminal portion.

A part of the fixed terminal portion 28GBB in the vicinity of its end is bent substantially perpendicularly to the connecting portion 28GBL in the same direction as the bent portion of the contact portion 28GBL at the top end is bent, i.e. toward the transmission blade 26. At the end of the fixed terminal portion, a horseshoe-shaped holder which holds the solder terminal 28Bi by caulking is formed.

In the transmission blade 26, the ground contact plates 28Gai are arranged on a same flat surface at predetermined intervals in the width direction of the transmission blade 26. Each ground contact plate 28Gai is a thin plate made of a copper alloy material, for example, a phosphor-bronze alloy material. Each ground contact plate 28Gai includes; a contact portion at one end; a fixed terminal portion 28*ga* at the other end, the fixed terminal portion 28*ga* having a columnar solder terminal 28Bi at a bent portion; and a connecting portion connecting the contact portion and the fixed terminal portion 28*ga*.

Figure 4:
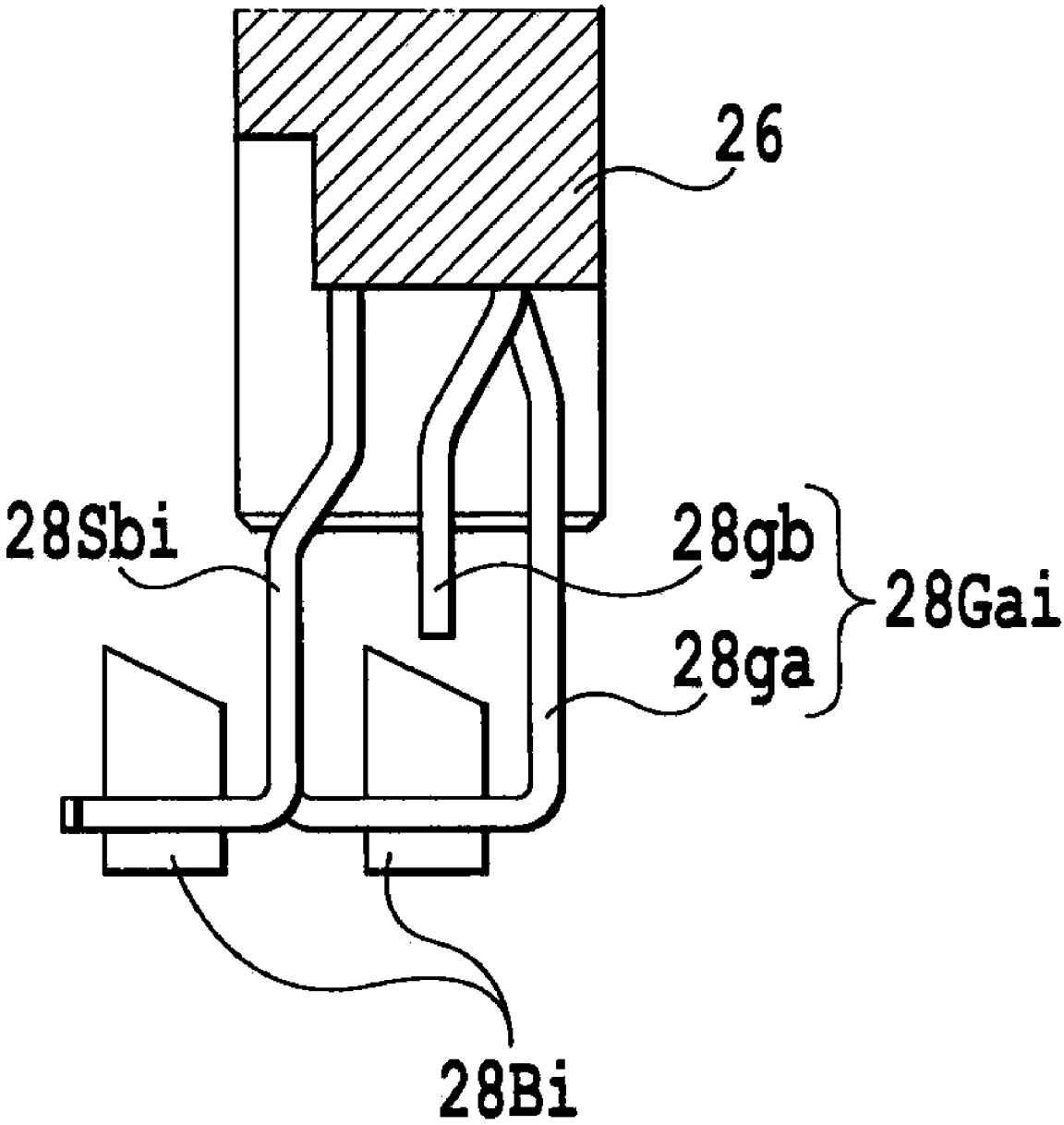
FIG. 4 is a partial enlarged cross-sectional view showing a part of FIG. 3.

The tip of the contact portion is bent in an arc according to the tip of the transmission blade 26. As shown in FIG. 4, the fixed terminal portion 28*ga* continuing from the aforementioned connecting portion protrudes orthogonally to the surface of the printed wiring board 12 and then is bent toward the other surface of the transmission blade 26. At the tip of the bent portion, the columnar solder terminal 28Bi is fixed by caulking.

Figure 3:
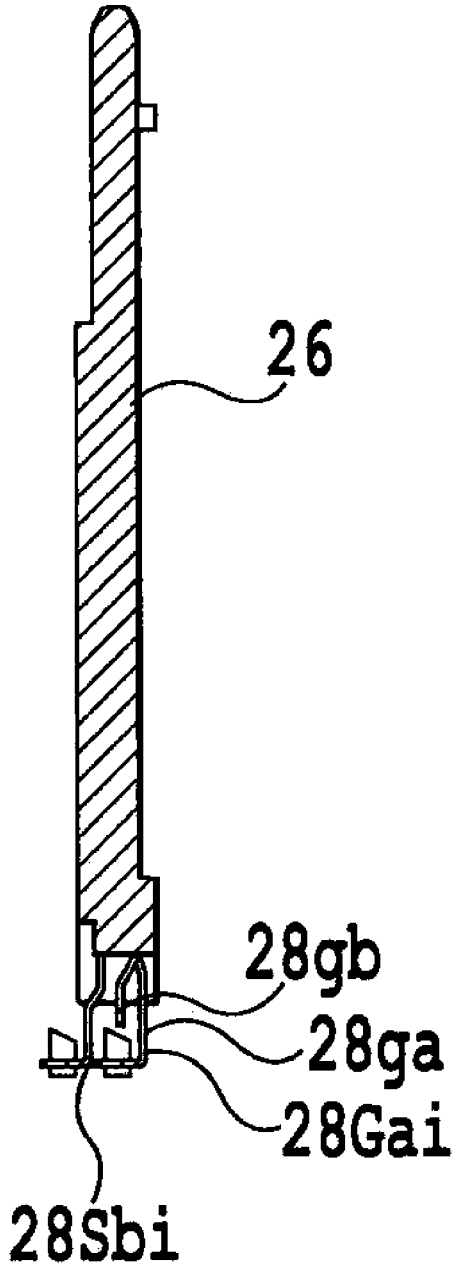
FIG. 3 is a partial cross-sectional view taken along a line III-III of FIG. 2.

As shown in FIG. 1, on both sides of the fixed terminal portion 28*ga*, a pair of shielding pieces 28*gb* is formed integrally with the connecting portion. As enlarged in FIGS. 3 and 4, the tips of the pair of shielding pieces 28*gb* are bent to be close to the fixed terminal portions of the aforementioned transmission contact terminals 28Sai and 28Sbi and to be positioned between the fixed terminal portions of the transmission contact terminals 28Sai and 28Sbi and the flat surface portion of the fixed terminal portion 28*ga*. By forming the pair of shielding pieces 28*gb* in this manner, crosstalk between the signal paths of the adjacent contact units 18Bi can be suppressed. Moreover, by adjusting the distance between the fixed terminal portions of the transmission contact terminals 28Sai and 28Sbi and the flat surface portion of the fixed terminal portion 28*ga*, impedance matching can be provided.

Figure 8:
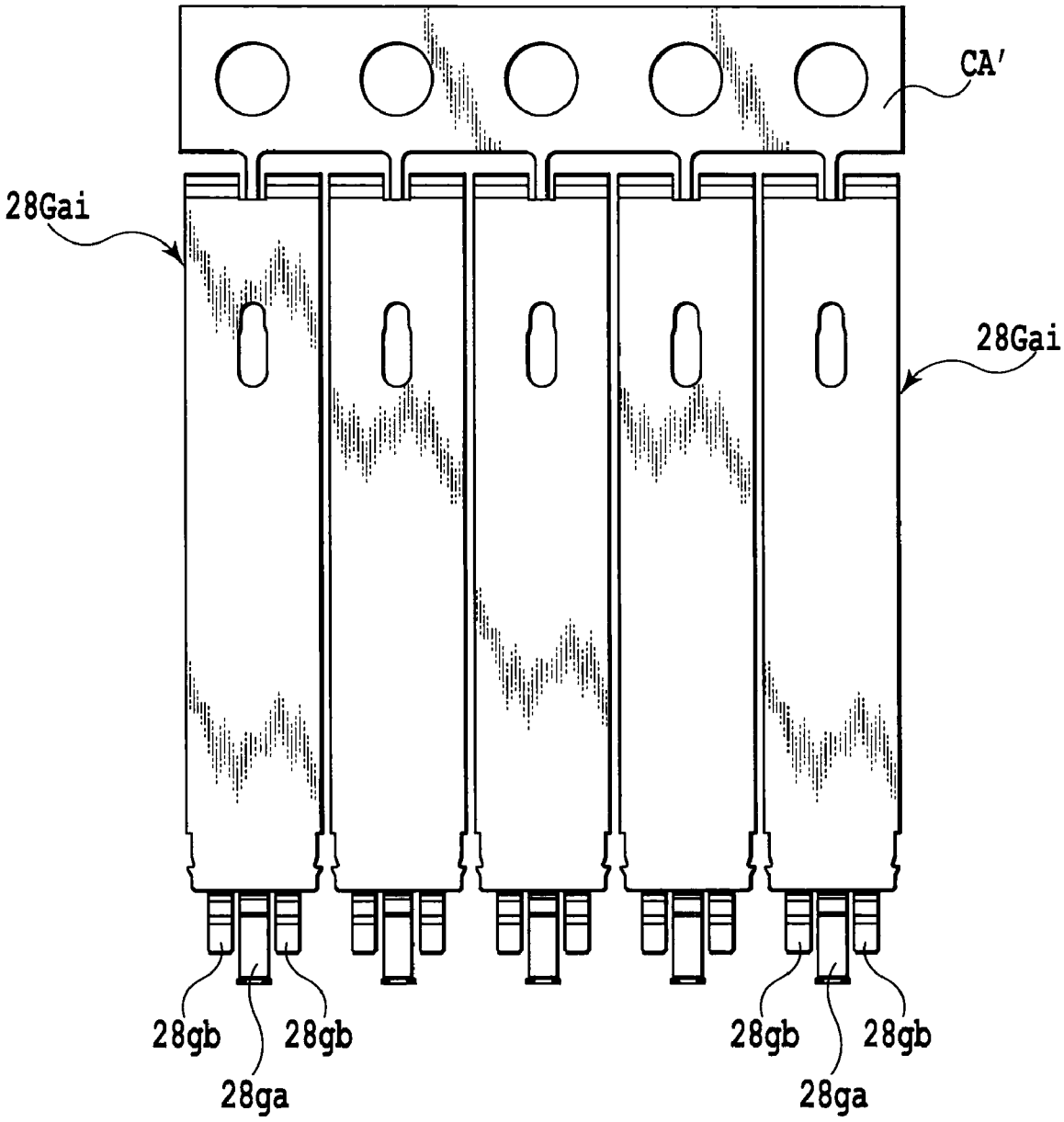
FIG. 8 is a front view showing a state of a set of ground contact plates used in a single contact unit shown in FIG. 1 at the time of manufacturing.
Figure 9:
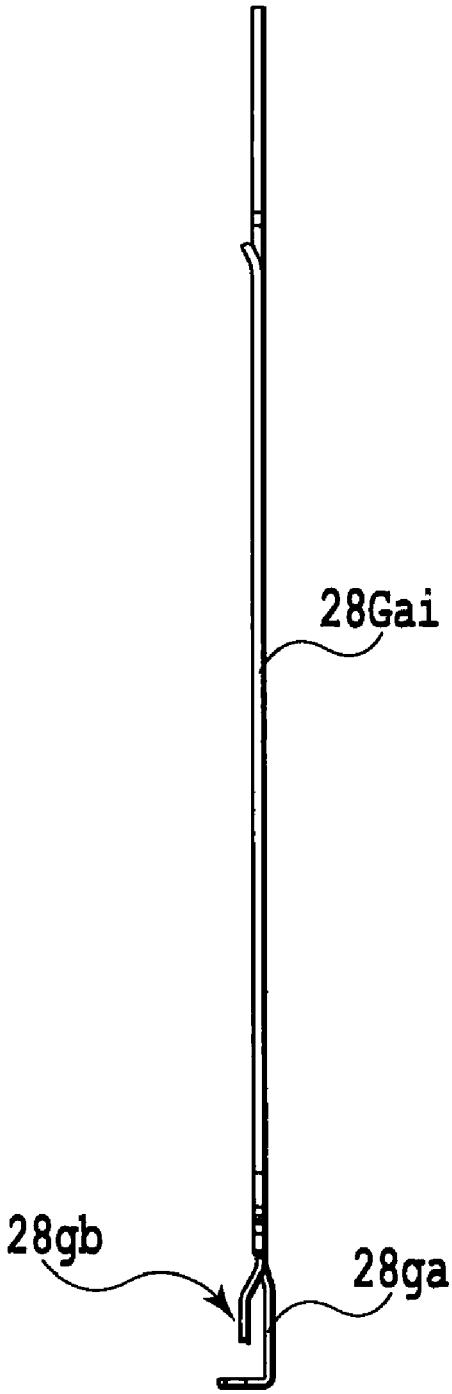
FIG. 9 is a side view showing the set of ground contact plates shown in FIG. 8.
Figure 10:
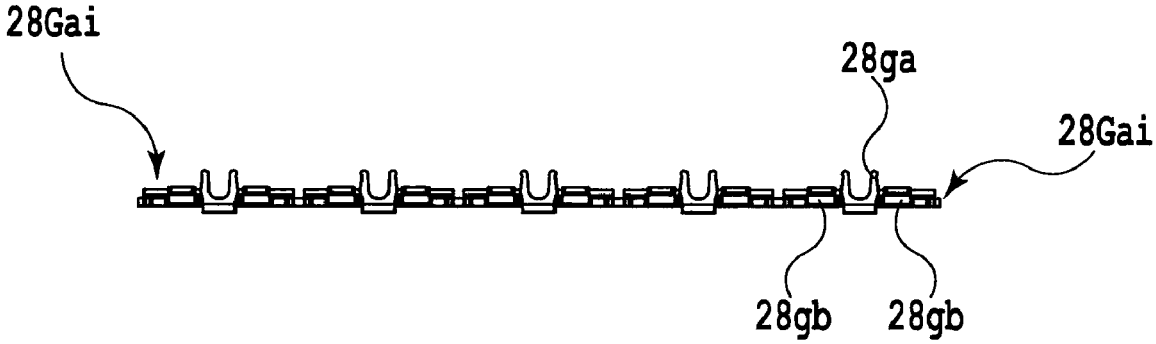
FIG. 10 is a bottom view of the set of ground contact plates shown in FIG. 8.

In case of manufacturing the ground contact plates 28Gai, except for the solder terminals 28Bi, by a presswork, as shown in FIGS. 8 to 10, for example, the ground contact plates 28Gai can be simultaneously obtained in a state where five of the ground contact plates 28Gai are held in a carrier CA' in parallel to each other. At that time, as enlarged in FIG. 10, at the tip of the bent portion of each fixed terminal portion 28*ga*, the horseshoe-shaped holding portion which holds the solder terminal 28Bi by caulking is integrally formed.

Figure 15:
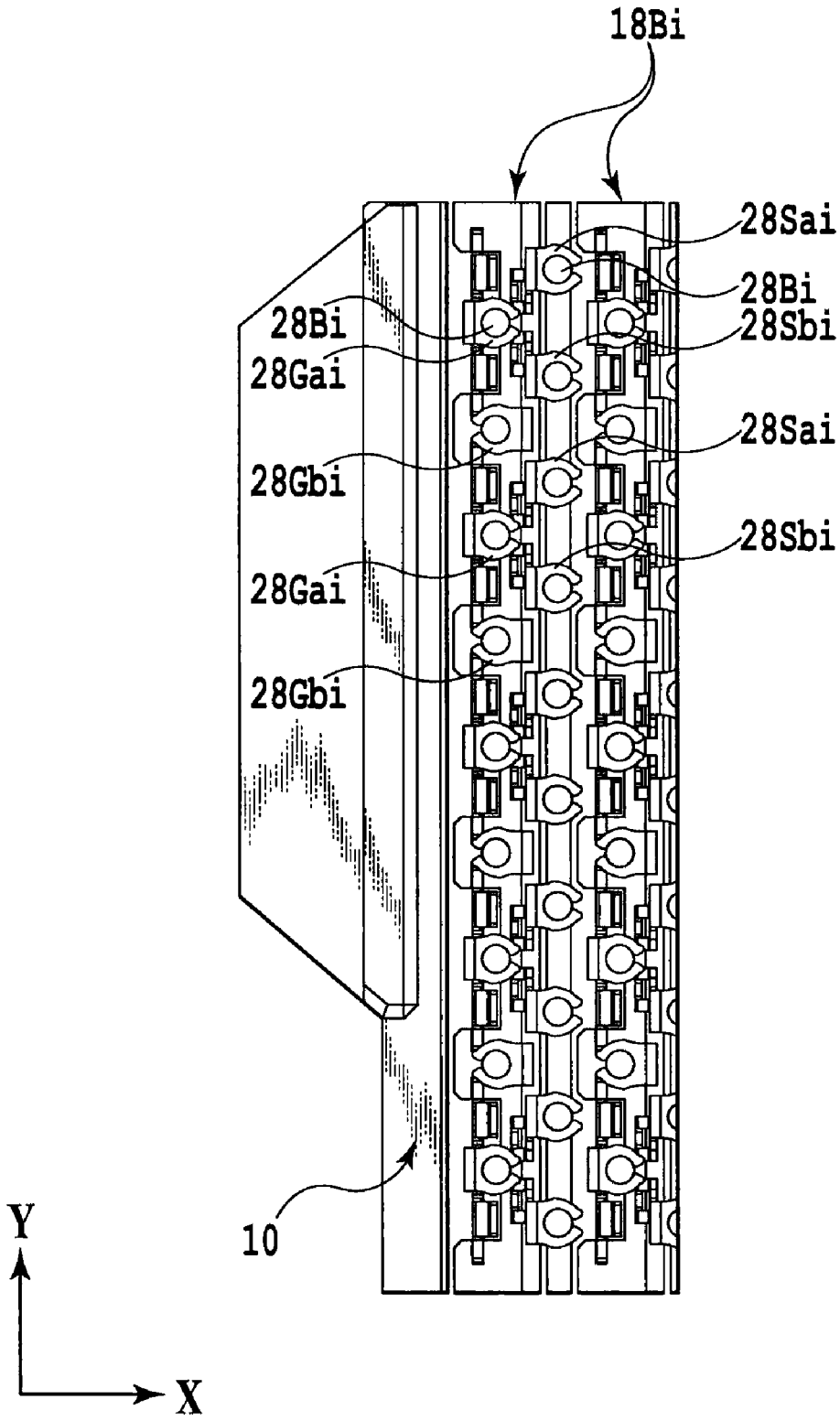
FIG. 15 is an enlarged bottom view showing a part of the plug section shown in FIG. 14.

Accordingly, as shown in FIG. 15, the solder terminals 28Bi of the fixed terminal portions 28SB of the transmission contact terminals 28Sai and 28Sbi in a contact-formed surface being one surface of transmission blade 26 are arranged at predetermined intervals in a same line extending along the Y coordinate axis. The solder terminals 28Bi of the ground contact plates 28Gai and the solder terminals 28Bi of the ground contact terminals 28Gbi in a contact plate-formed surface being the other surface of the transmission blade 26 are arranged at predetermined intervals in a same line extending along the Y coordinate axis.

The line of the solder terminals 28Bi of the fixed terminal portions 28SB of the transmission contact terminals 28Sai and 28Sbi in the contact-formed surface is substantially in parallel to the line of the solder terminals 28Bi of the ground contact plates 28Gai in the contact plate-formed surface. Each of the solder terminals 28Bi of the ground contact plates 28Gai in the contact plate-formed surface is at a position corresponding to a position between the solder terminals 28Bi of the fixed terminal portions 28Sb of a corresponding pair of the transmission contact terminals 28Sai and 28Sbi. Furthermore, the solder terminals 28Bi of the ground contact terminals 28Gbi arranged between adjacent sets of the transmission contact terminals 28Sai and 28Sbi are uniformly arranged in the same line as the solder terminals 28Bi of the ground contact plates 28Gai in the contact plate-formed surface. In other words, each of the solder terminals 28Bi of the ground contact terminals 28Gbi is arranged between the solder terminals 28Bi of the two adjacent ground contact plates 28Gai.

In FIG. 1, typically, five ground contact plates 28Gai are provided, but the present invention is not limited to this example. The number of ground contact plates 28Gai can be properly set according to the conductor pattern of the later-described printed wiring board 12.

Figure 16:
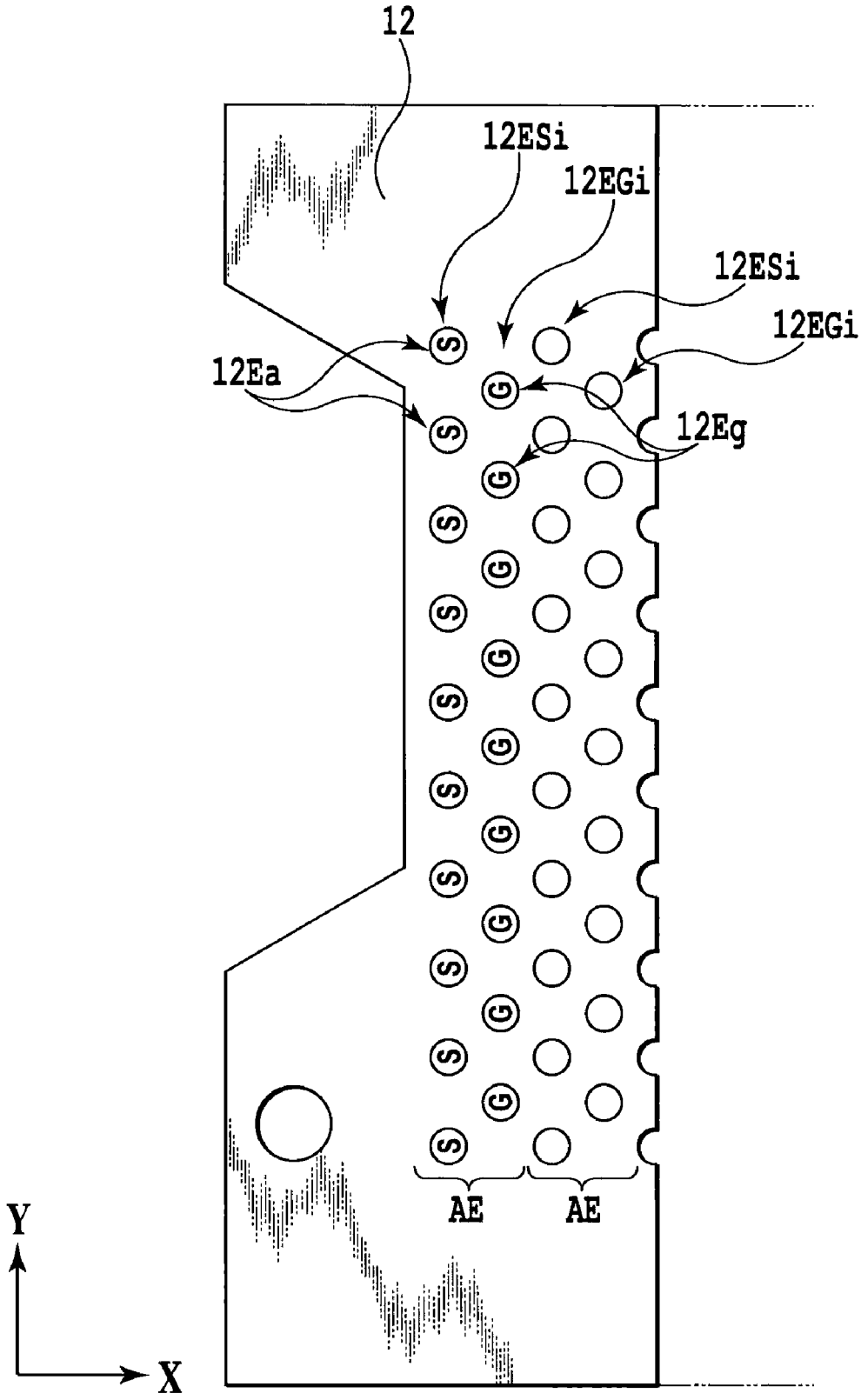
FIG. 16 is a plan view showing a part of a conductor pattern of a printed wiring board to which the plug section shown in FIG. 5 is fixed.

The conductor pattern in the printed wiring board 12 to which the solder terminals 28Bi of the aforementioned transmission blades 26 are soldered and fixed is formed as partial enlarged in FIG. 16. The conductor pattern in the printed wiring board 12 can be selectively utilized for system using the single-ended or differential transmission scheme.

FIG. 16 shows a part of the conductor pattern in which multiple the contact units 18Bi adjacent to each other are to be arranged. In FIG. 16, each area AE shows an area where one of the contact units 18Bi is to be placed. The contact units 18Bi are to be arranged in parallel to each other at predetermined intervals in the X coordinate axis in FIG. 16, i.e. along a long side of the casing 10C.

Each area AE in the conductor pattern includes a line of a contact pad group 12Esi including contact pads 12Ea to which the solder terminals 28Bi of the transmission contact terminals 28Sai and 28Sbi of one of the contact units 18Bi are soldered and fixed, and includes a line of a contact pad group 12EGi including contact pads 12Eg to which the solder terminals 28Bi of the ground contact plates 28Gai and 28Gbi of the same contact unit 18Bi are soldered and fixed. The line of a contact pad group 12Esi and the line of a contact pad group 12EGi are formed adjacent to each other. The contact pads 12Ea and 12Eg are formed at predetermined intervals along the Y coordinate axis orthogonal to the X coordinate axis in FIG. 16.

Each of the contact pads 12Eg is formed at a position corresponding to a position between the corresponding contact pads 12Ea. In the case of the differential transmission system, for example, the first and second contact pads 12Ea from the end of the line of the contact pad group 12ESi are used for a single channel. The third and fourth contact pads 12Ea adjacent thereto are used for another channel. Furthermore, the second contact pad 12Eg from the end of the line of the contact pad group 12EGi is at a position corresponding to a position between the adjacent first and second pairs of contact pads 12Ea.

In the case of the single-ended transmission system, for example, the even numbers of the contact pads 12Ea from the end of the line of the contact pad group 12ESi are each paired with the corresponding odd number of the contact pads 12Eg from the end of the line of contact pad group 12EGi. Each of the thus obtained pairs of contact pads 12Ea and 12Eg is used as a single channel.

In the area AE adjacent to the above-mentioned area AE, lines of the contact pad groups 12ESi and 12EGi are formed to have a similar configuration.

Figure 7:
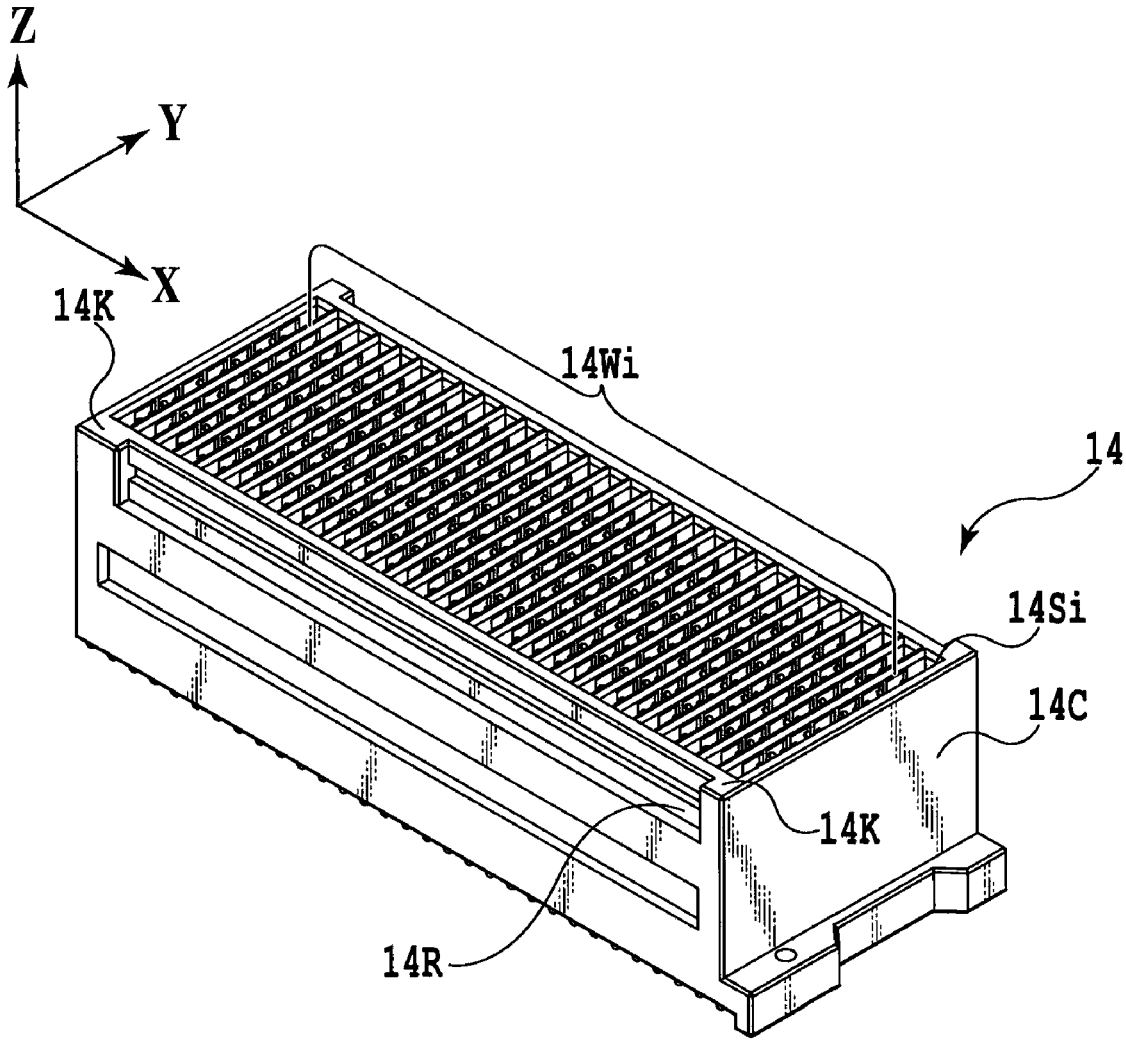
FIG. 7 is a perspective view showing a socket section used in the embodiment of the high-speed transmission connector according to the present invention.

On the other hand, as enlarged in FIG. 7, the socket section 14 includes slits 14Si (i=1 to n, where n is a positive integer) inside a casing 14C. The slits 14Si penetrate to one end of the casing made of a resinous material, for example, liquid crystal polymer, and corresponds to the contact units 18Bi of the aforementioned plug section 10. The inner dimension of each slit 14Si is set slightly larger than the thickness of the contact units 18Bi. Each two adjacent slits 14Si are partitioned with a partition wall 14Wi (i=1 to n, where n is a positive integer).

The slits 14Si of the casing 14C respectively accommodate contact units 38Bi.

Figure 25:
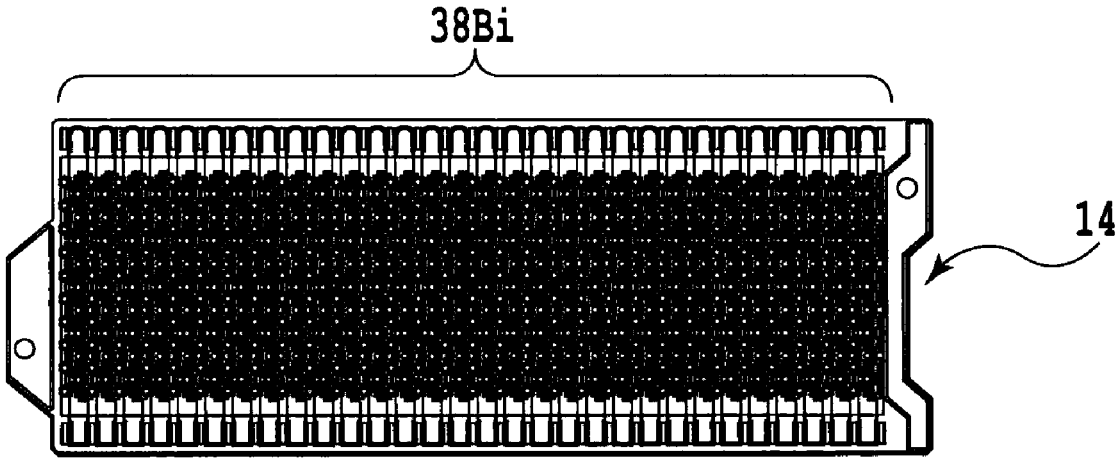
FIG. 25 is a bottom view of the socket section shown in FIG. 7.

One open end of each slit 14Si is opened to an end surface of the socket section 14 to be fixed to the printed wiring board 16 as shown in FIG. 25. As enlarged in FIG. 26, multiple solder terminals 42Bi are exposed at the one open end of each slit 14Si.

Each of the socket contact units 38Bi are electrically connected to the transmission contact terminals 28Sai and 28Sbi, ground contact terminals 28Gbi, and ground contact plates 28Gai of the corresponding contact unit 18Bi of the aforementioned plug section 10. As enlarged in FIG. 17, each socket unit 38*i* includes: multiple, for example five, ground contact plates 48Gai (i=1 to 5); four ground contact terminals 48Gbi (i=1 to 4) (see FIG. 2); multiple, for example five each, transmission contact terminals 48Sai and 48Sbi (i=1 to 5) transmitting signals or data; and a transmission blade 46 supporting the ground contact plates 48Gai, ground contact terminals 48Gbi, and transmission contact terminals 48Sai and 48Sbi in both sides thereof.

The transmission contact terminals 48Sai and 48Sbi, ground contact plates 48Gai, ground contact terminals 48Gbi of each socket contact unit 38Bi are arranged corresponding to the arrangement of the transmission contact terminals, ground contact plates, and ground contact terminals of the corresponding contact unit 18Bi of the plug section 10.

Figure 18:
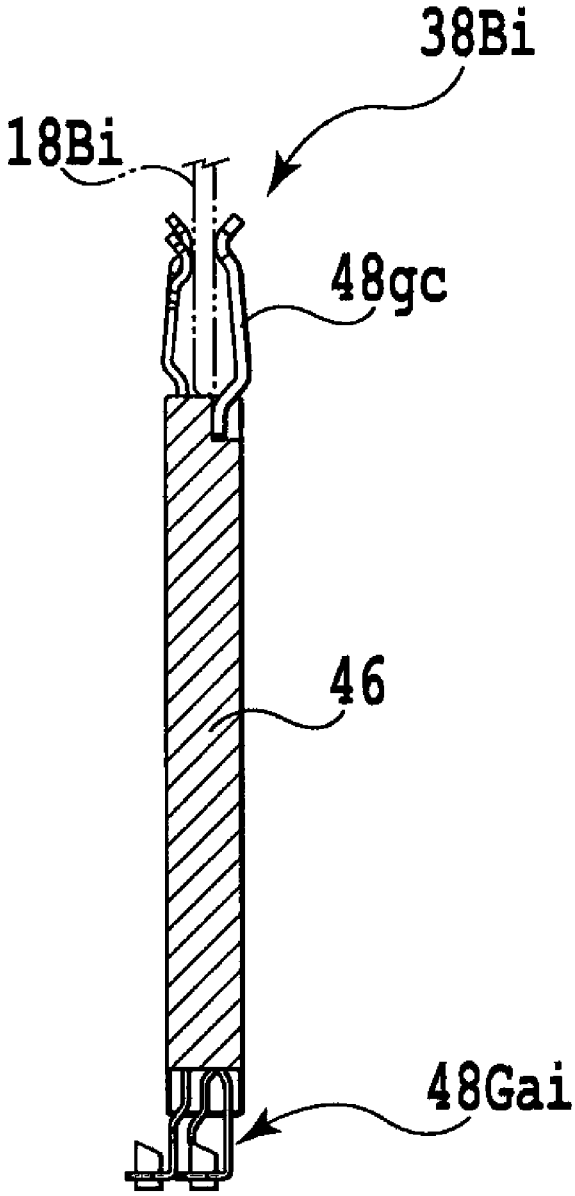
FIG. 18 is a partial cross-sectional view of the contact unit shown in FIG. 17.

Specifically, as indicated by dashed double dotted lines in FIG. 18, the contact units 18Bi of the plug section are sandwiched by the terminal portions of the later-described transmission contact terminals 48Sai and 48Sbi and terminal portions of the ground contact plates 48Gai and ground contact terminals 48Gbi with predetermined pressure due to the elastic force thereof. The transmission contact terminals 48Sai and 48Sbi are thus respectively connected to the transmission contact terminals 28Sai and 28Sbi of the contact units 18Bi of the plug section 10, and the ground contact plates 48Gai and ground contact terminals 48Gbi are respectively connected to the ground contact plates 28Gai and ground contact terminals 28Gbi of the contact units 18Bi.

Figure 17:
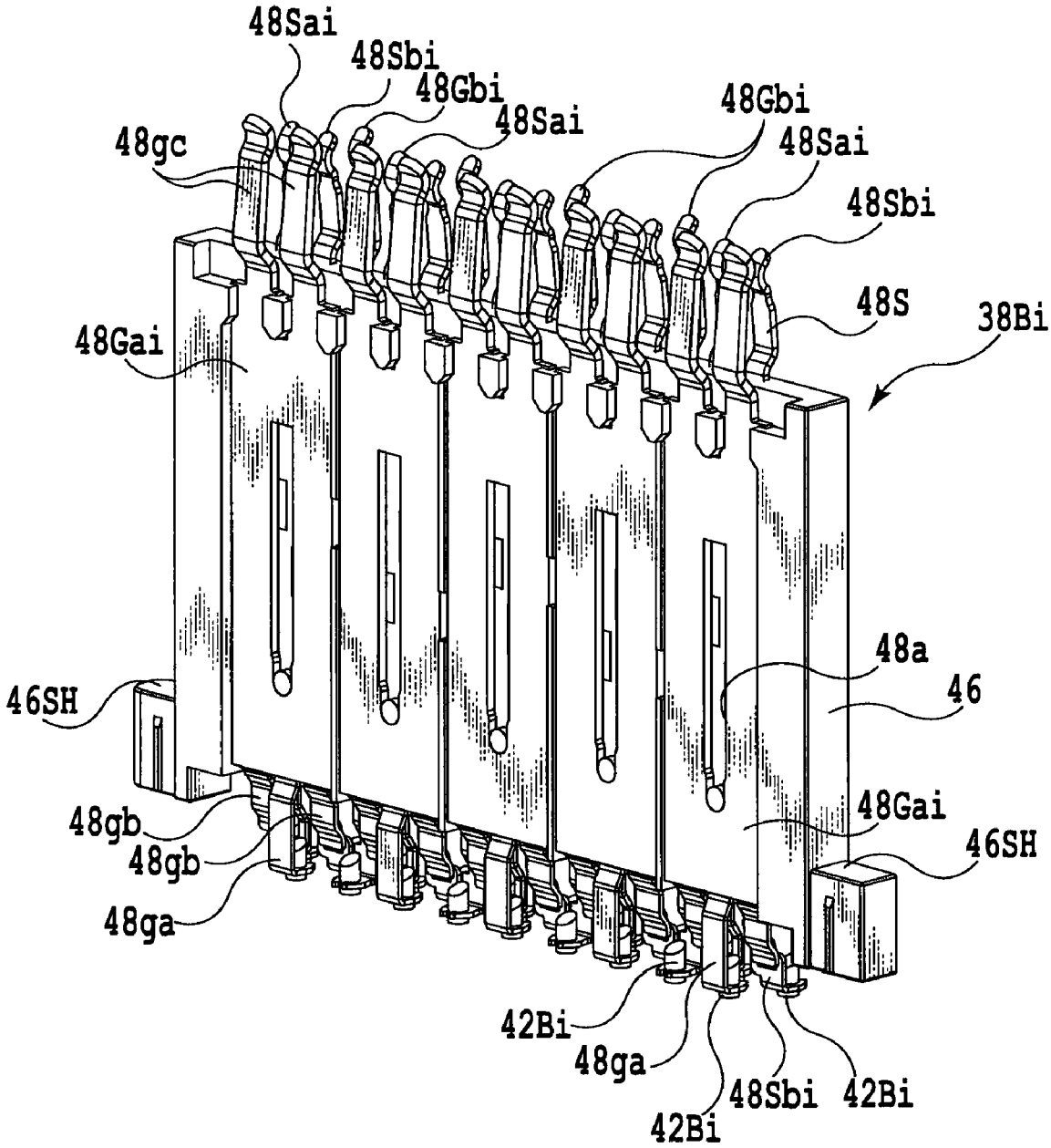
FIG. 17 is a perspective view showing an appearance of the contact unit in the socket section used in the embodiment of the high-speed transmission connector according to the present invention.

The transmission blade 46 is a thin plate with a thickness of about 1 mm and is molded of a resinous material. The transmission blade 46 has fitting portions 46SH at both ends of the bottom end, the fitting portions 46SH being fit to the open ends of the aforementioned slit 14Si. On one surface of the transmission blade 46, relatively shallow grooves are formed as shown in FIG. 17, into which the ground contact plates 48Gai are inserted, respectively. At predetermined positions in an upper part of the groove and lower part of the groove, positioning pins which are engaged with an upper portion and a hole 48*a* of the later-described ground contact plates 48Gai are formed, respectively.

At an edge of the other surface of the transmission blade 46, contact portions protrude, the contact portions formed in upper parts of the ground contact terminals 48Gbi and transmission contact terminals 48Sai and 48Sbi, which are simultaneously casted at the insert molding. The transmission contact terminals 48Sai and 48Sbi and ground contact terminals 48Gbi are thin plates made of a copper alloy material, for example, a phosphor-bronze alloy material, and in FIG. 17, are arranged in the following order starting from the left end: a pair of transmission contact terminals 48Sai and 48Sbi, the first ground contact terminal 48Gbi, another pair of transmission contact terminals 48Sai and 48Sbi, the second ground contact terminal 48Gbi, another pair of transmission contact terminals 48Sai and 48Sbi, the third ground contact terminal 48Gbi, another pair of transmission contact terminals 48Sai and 48Sbi, the fourth ground contact terminal 48Gbi, and another pair of transmission contact terminals 48Sai and 48Sbi.

The contact portions of the ground contact terminals 48Gbi and the contact portions of the later described ground contact terminals 48Gai are set longer than the contact portions of the pairs of transmission contact terminals 48Sai and 48Sbi.

At the operation of attaching/detaching the plug section 10 to and from the socket section 14, the contact portions of the ground contact terminals 48Gbi and ground contact plates 48Gai come into contact with the contact portions of the ground contact terminals 28Gbi and ground contact plates 28Gai of the plug section 10 before the pair of transmission contact terminals 48Sai and 48Sbi come into contact with the transmission contact terminals of the plug section 10. Accordingly, forces required to insert and extract the plug section 10 at the start of the attachment/detachment operations are reduced, thus facilitating the operations of attaching/detaching the plug section 10 to and from the socket section 14.

Each of the transmission contact terminals 48Sai and 48Sbi comprises: an elastic contact portion formed in its upper part; a fixed terminal portion formed at its lowest part; and a connecting portion connecting the contact portion and fixed terminal portion.

Figure 19:
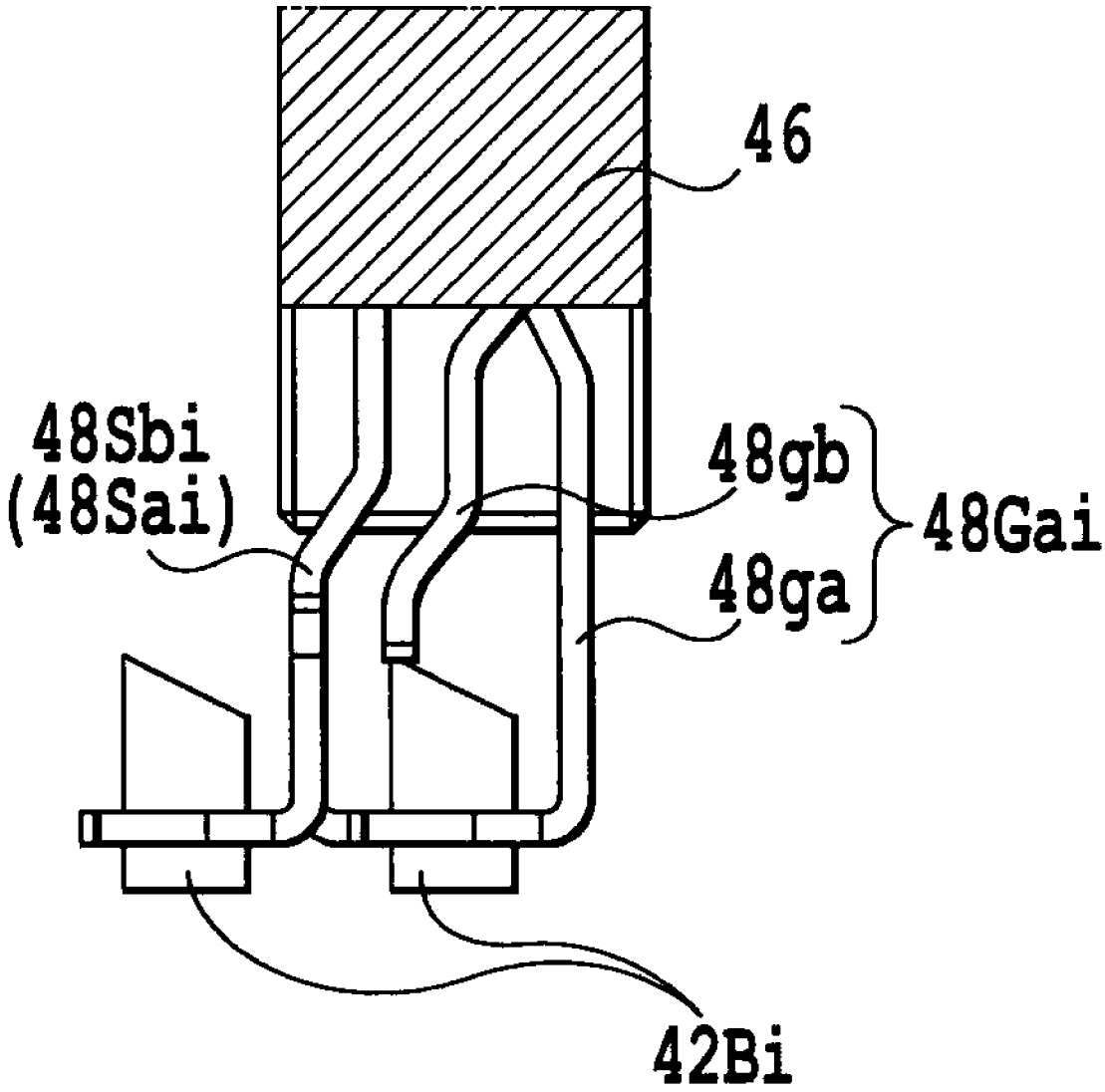
FIG. 19 is a partial enlarged cross-sectional view showing a part of FIG. 18.

The fixed terminal portion of each transmission contact terminal 48Sai is formed so as to be deviated toward the left by a predetermined amount with respect to the central axis of the contact portion and connecting portion in FIG. 17. As shown in FIG. 19, the fixed terminal portion is bent in a direction opposite to the direction in which the bent portion at the tip of the contact portion is bent, i.e. in a direction away from the transmission blade 46. Furthermore, a hole is formed in the fixed terminal portion to prevent a crack from occurring in the solder terminal 42Bi upon soldering the solder terminal onto the printed wiring board 16 and increase spring strength of the terminal portion. The hole has the same shape as that of the holes 28LH of the aforementioned transmission contact terminals 28Sai. At the utmost portion of the fixed terminal portion, a horseshoe-shaped holding portion which holds the solder terminal 48Bi by caulking is formed.

The fixed terminal portion of each transmission contact terminal 48Sbi is formed so as to be deviated toward the right by a predetermined amount with respect to the central axis of the contact portion and connecting portion in FIG. 17. As shown in FIG. 19, the fixed terminal portion is bent in a direction opposite to the direction in which the bent portion at the tip of the contact portion is bent, i.e. in a direction away from the transmission blade 46. Furthermore, a hole is formed in the fixed terminal portion to prevent a crack from occurring in the solder terminal 42Bi and increase spring strength of the terminal portion. The hole has the same shape as that of the holes 28RH of the aforementioned transmission contact terminals 28Sbi. At the utmost portion of the fixed terminal portion, a horseshoe-shaped holding portion which holds the solder terminal 42Bi by caulking is formed.

Figure 23:
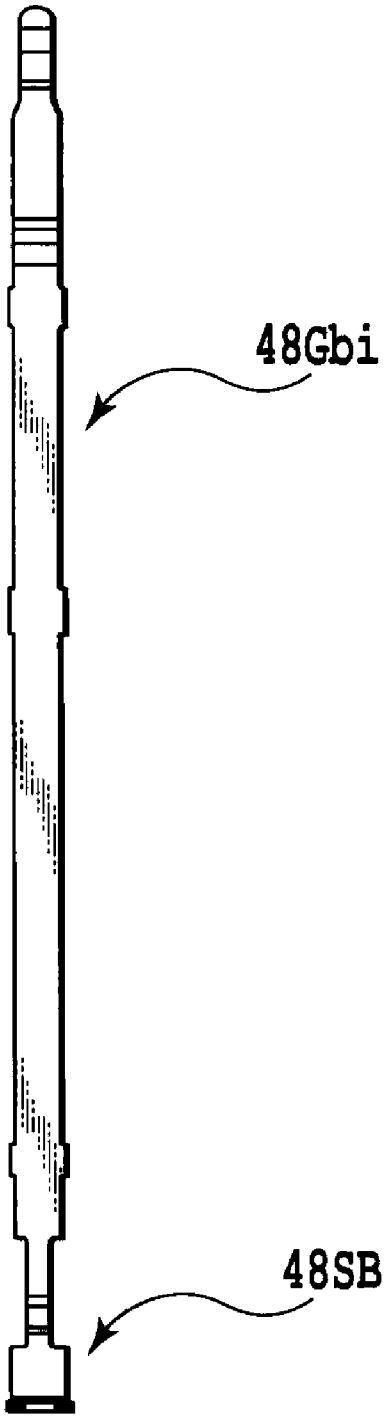
FIG. 23 is a front view showing a ground contact terminal used in the contact unit shown in FIG. 17.
Figure 24:
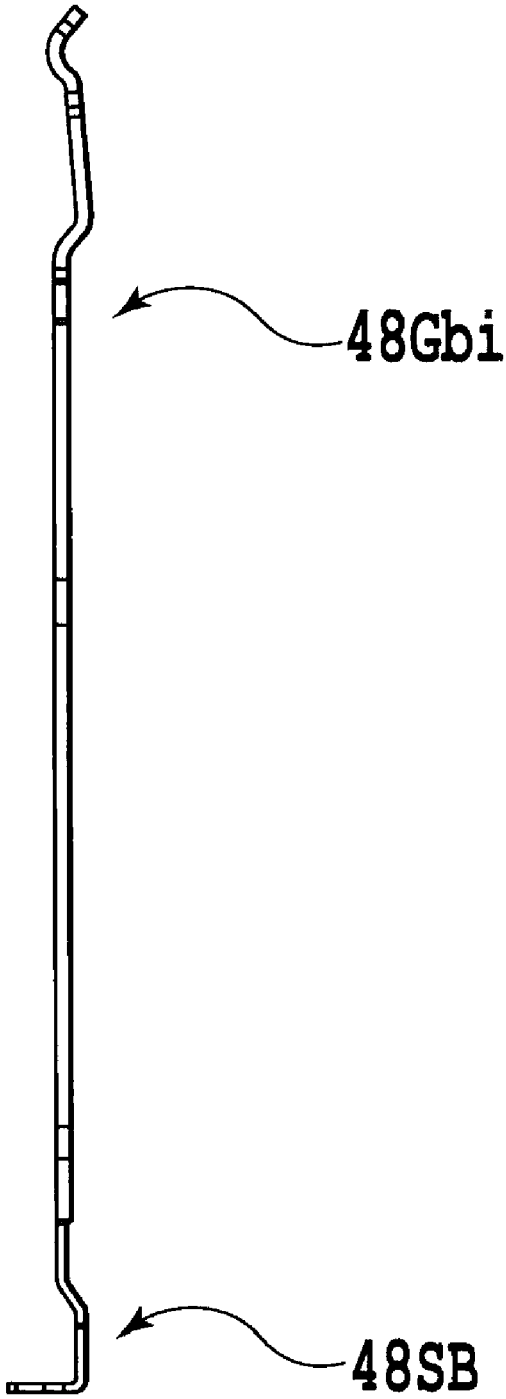
FIG. 24 is a side view of the ground contact terminal shown in FIG. 23.

As shown in FIGS. 23 and 24, each ground contact terminal 48Gbi comprises: an elastic contact portion formed in its upper part; a fixed terminal portion formed at its lowest part; and a connecting portion connecting the contact portion and the fixed terminal portion.

The fixed terminal portion 48SB is bent in a direction opposite to the direction that the bent portion of the contact portion at the tip is bent, i.e. a direction moving closer to the transmission blade 46. At the utmost portion of the fixed terminal portion 48SB, a horseshoe-shaped holding portion which holds the solder terminal 42Bi by caulking is formed.

As shown in FIG. 17, in the transmission blade 46, each ground contact plates 48Gai are arranged on a same flat surface of the transmission blade 46 at predetermined intervals in the width direction. The ground contact plate 48Gai is a thin plate made of a copper alloy material, for example, a phosphor-bronze alloy material. Each ground contact plate 48Gai comprises: a contact portion at one end; a fixed terminal portion 48*ga* at the other end, the fixed terminal portion 48*ga* having the columnar solder terminal 42Bi at a bent portion; and a connecting portion connecting the contact portion and the fixed terminal portion 48*ga*.

Figure 20:
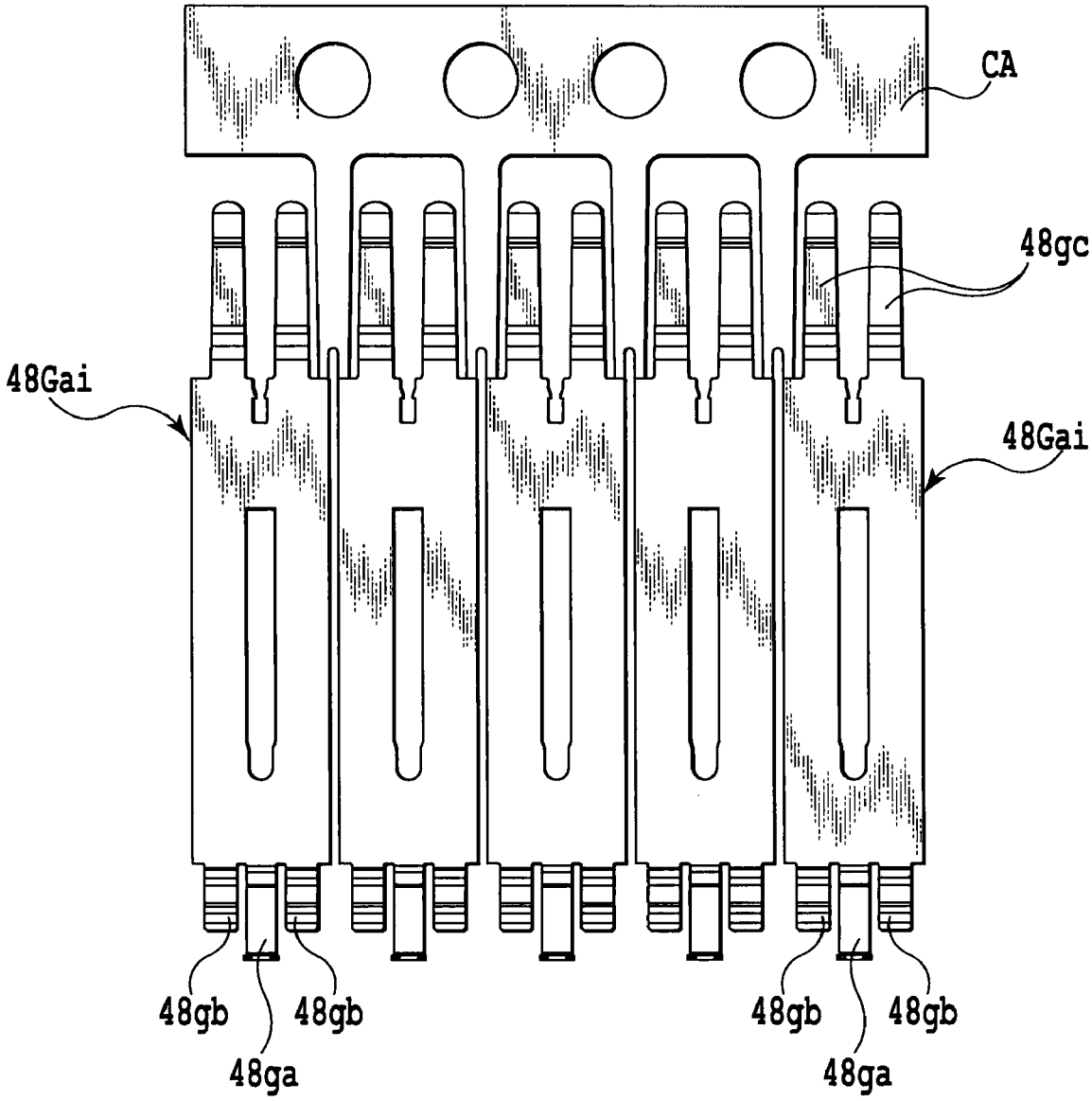
FIG. 20 is a front view showing a state of a set of ground contact plates used in the single contact unit shown in FIG. 17 at the time of manufacturing.
Figure 21:
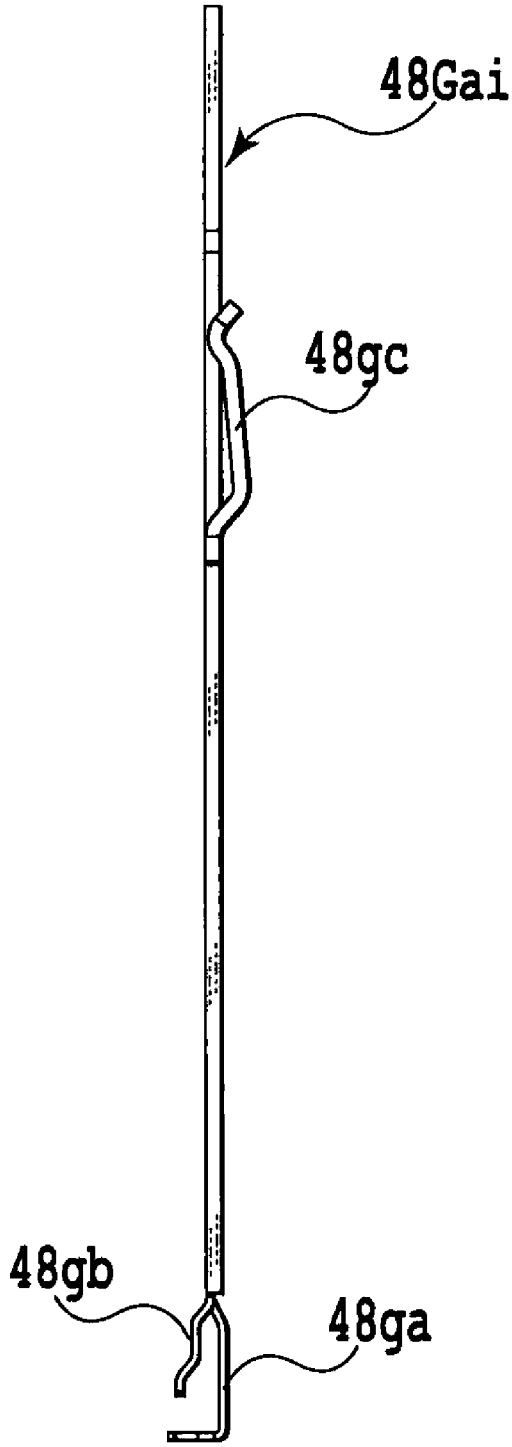
FIG. 21 is a side view of the set of ground contact plates shown in FIG. 20.

The tips of the elastic contact portions 48*gc* protrude from the upper edge of the transmission blade 46 and are bent in an arc (see FIGS. 20 and 21). As shown in FIG. 19, the fixed terminal portion 48*ga* continuing from the aforementioned connecting portion protrudes orthogonally to the surface of the printed wiring board 16 and is then bent toward the other surface of the transmission blade 46. At the tip of the bent portion, the columnar solder terminal 42Bi is fixed by caulking.

As shown in FIGS. 17 and 20, on both sides of the fixed terminal portion 48*ga*, a pair of shielding pieces 48*gb* are formed integrally with the connecting portion. As enlarged in FIG. 19, the tips of the pair of shielding pieces 48*gb* are bent to be close to the fixed terminal portions of the aforementioned transmission contact terminals 48Sai and 48Sbi and to be positioned between the fixed terminal portions of the transmission contact terminals 48Sai and 48Sbi and the flat surface portion of the fixed terminal portion 48*ga*. By forming the pair of shielding pieces 48*gb* in such a manner, crosstalk between the signal paths of adjacent contact units 38Bi can be suppressed.

Figure 22:
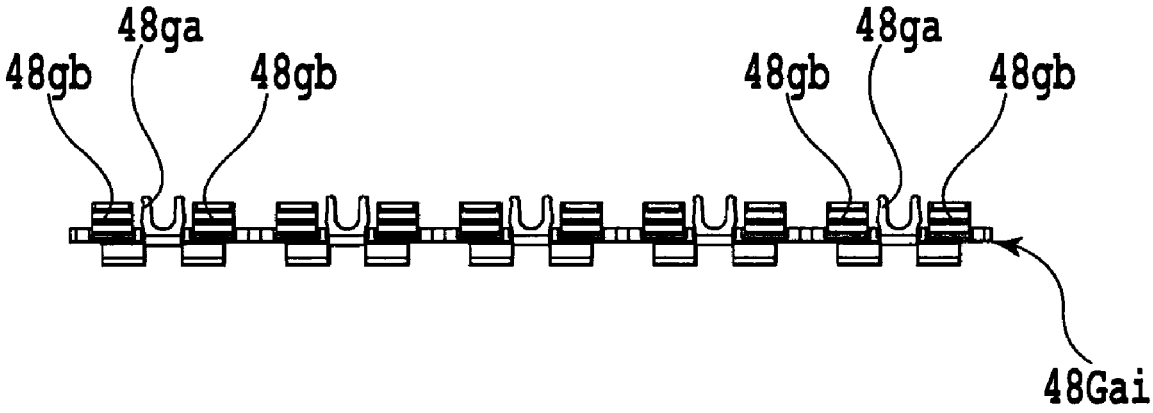
FIG. 22 is a bottom view of the set of ground contact plates shown in FIG. 20.

In case of manufacturing the ground contact plates 48Gai, except for the solder terminals 42Bi, by a presswork, as shown in FIGS. 20 to 22, for example, the ground contact plates 48Gai can be obtained at the same time in a state where five of the ground contact plates 48Gai are held in a carrier CA in parallel to each other. At that time, as enlarged in FIG. 22, at the tip of the bent portion of each fixed terminal portion 48*ga*, the horseshoe-shaped holding portion which holds the solder terminal 42Bi by caulking is integrally formed.

Figure 26:
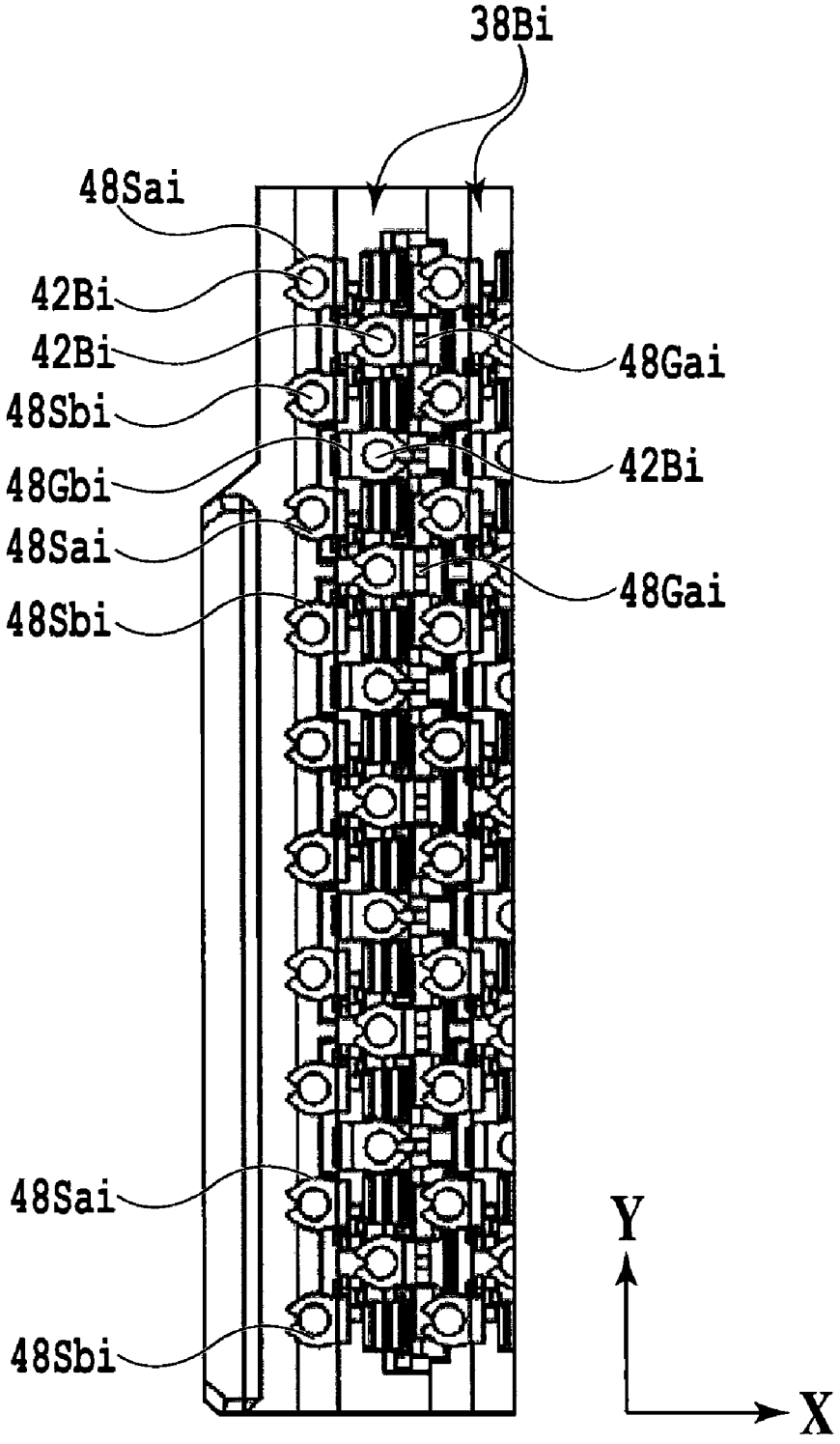
FIG. 26 is an enlarged bottom view of a part of the socket section shown in FIG. 25.

Accordingly, as shown in FIG. 26, the solder terminals 42Bi of the fixed terminal portions 48SB of the transmission contact terminals 48Sai and 48Sbi in a contact-formed surface being one surface of the transmission blade 46 are arranged at predetermined intervals in a same line extending along the Y coordinate axis. The solder terminals 42Bi of the ground contact plates 48Gai and the ground contact terminals 48Gbi in a contact plate-formed surface being the other surface of the transmission blade 46 are arranged at predetermined intervals in a same line extending along the Y coordinate axis.

The line of the solder terminals 42Bi of the fixed terminal portions of the transmission contact terminals 48Sai and 48Sbi in the contact-formed surface is substantially in parallel to the line of the solder terminals 42Bi of the ground contact plates 48Gai in the contact plate-formed surface. Each of the solder terminals 48Bi of the ground contact plates 48Gai in the contact plate-formed surface is at a position corresponding to a position between the solder terminals 42Bi of the fixed terminal portions of a corresponding pair of the transmission contact terminals 48Sai and 48Sbi. Furthermore, the solder terminals 42Bi of the ground contact terminals 48Gbi arranged between adjacent sets of the transmission contact terminals 48Sai and 48Sbi are uniformly arranged in the same line of the solder terminals 42Bi of the ground contact plates 48Gai in the contact plate-formed surface. In other words, each of the solder terminals 42Bi of the ground contact terminals 48Gbi is arranged between the solder terminals 42Bi of the two adjacent ground contact plates 48Gai.

In FIG. 17, typically, five ground contact plates 48Gai are provided, but the present invention is not limited to such an example. The number of ground contact plates 48Gai can be properly set according to the conductor pattern of the later-described printed wiring board 16.

The conductor pattern in the printed wiring board 16 to which the solder terminals 42Bi of the aforementioned transmission blades 46 are soldered and fixed can be, like the conductor pattern in the printed wiring board 12, i.e. selectively used for the single-ended or differential transmission system. The conductor pattern of the printed wiring board 16 has a constitution similar to that of the aforementioned printed wiring board 12.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A high-speed transmission connector, comprising:

a plurality of first contact units each having;

a pair of transmission contact terminals each of which has a fixed terminal portion fixed to a first wiring board, and which respectively form two adjacent high-speed signal transmission paths on one common flat surface of a transmission blade;

ground contact terminals each of which has a fixed terminal portion fixed to the first wiring board, and which are provided respectively between pairs of said transmission contact terminals; and a plurality of ground contact plates provided on another common flat surface of the transmission blade;

a plug section having a casing accommodating said first contact units;

a plurality of second contact units each having;

a pair of transmission contact terminals each of which has a fixed terminal portion fixed to a second wiring board, and which respectively form two adjacent high-speed signal transmission paths on one common flat surface of a transmission blade;

ground contact terminals each of which has a fixed terminal portion fixed to the second wiring board, and which are provided respectively on both sides of the pair of transmission contact terminals; and a plurality of ground contact plates provided on another common flat surface of the transmission blade; and a socket section capable of being selectively connected to said plug section, said socket section having a casing accommodating said second contact units, wherein a pair of transmission contact terminals of said first and second contact units is provided so as to be opposed to one of the ground contact plate.

2. The high-speed transmission connector according to claim 1, wherein each of the ground contact plates of each of said first contact units has a shielding piece protruding toward the first wiring board to partition off between the fixed terminal portions of the pair of transmission contact terminals of said adjacent first contact unit, and each of the ground contact plates of each of said second contact units has a shielding piece protruding toward the second wiring board to partition off between the fixed terminal portions of the pair of transmission contact terminals of said adjacent second contact unit.

3. The high-speed transmission connector according to claim 1, wherein each of the fixed terminal portions of the ground contact terminals in said first contact units and said second contact units is bent toward a position between the fixed terminal portions of the ground contact plates to be arranged in line with the fixed terminal portions of the ground contact plates.

4. The high-speed transmission connector according to claim 1, wherein the ground contact plates in said first contact units and said second contact units are separated so as to correspond to the pair of the transmission contact terminals.

5. The high-speed transmission connector according to claim 1, wherein a width of plate-shaped contact portions of the ground contact terminals in said first and second contact units each are set to a width wider than that of each of plate-shaped contact portions of the pairs of transmission contact terminals.

6. The high-speed transmission connector according to claim 1, wherein each of the fixed terminal portions of the pairs of transmission contact terminals in said first and second contact units has a holding portion for holding a solder terminal and a through-hole in the vicinity of the holding portion.

7. The high-speed transmission connector according to claim 1, wherein the fixed terminal portions of each pair of transmission contact terminals in said first and second contact units are bent in directions away from each other, and each have a holding portion for holding a solder terminal.

8. The high-speed transmission connector according to claim 1, wherein a length of contact portions of the ground contact terminals and ground contact plates in said second contact units each are set to a length longer than that of each of contact portions of the pairs of transmission contact terminals.

9. A plug for a high-speed transmission connector, comprising:

a plurality of contact units each having;

a pair of transmission contact terminals each of which has a fixed terminal portion fixed to a wiring board, and which respectively form two adjacent high-speed signal transmission paths on one common flat surface of a transmission blade;

ground contact terminals each of which has a fixed terminal portion fixed to the wiring board, and which are arranged respectively on both sides of the pair of transmission contact terminals; and a plurality of ground contact plates arranged on another common flat surface of the transmission blade; and a casing accommodating said contact units, wherein each of the ground contact plates of each of said contact units has a shielding piece protruding toward the wiring board so as to partition off between the fixed terminal portions of the pair of transmission contact terminals of said adjacent contact unit.

10. A socket for a high-speed transmission connector, comprising:

a plurality of contact units having;

a pair of transmission contact terminals each of which has a fixed terminal portion fixed to a wiring board, and which respectively form two adjacent high-speed signal transmission paths on one common flat surface of a transmission blade;

ground contact terminals each of which has a fixed terminal portion fixed to the wiring board, and which are arranged respectively on both sides of the pair of transmission contact terminals; and a plurality of ground contact plates arranged on another common flat surface of the transmission blade; and a casing accommodating said contact units, wherein each of the ground contact plates of each of said contact units has a shielding piece protruding toward the wiring board so as to partition off between the fixed terminal portions of the pair of transmission contact terminals of said adjacent contact unit.

* * * * *